United States Patent [19]

Davenport et al.

[11] Patent Number: 4,574,219

[45] Date of Patent: Mar. 4, 1986

[54] LIGHTING UNIT

[75] Inventors: John M. Davenport, Lyndhurst; Richard L. Hansler; Ralph M. Potter, both of Pepper Pike; John M. Blank, Windsor; Dimitri M. Speros, Painesville; Arthur S. Homa, Cleveland Hts.; Amarendra Mishra, Lyndhurst; Robert A. Leskovec, Richmond Hts., all of Ohio

[73] Assignee: General Electric Company, Schenectady, N.Y.

[21] Appl. No.: 613,926

[22] Filed: May 25, 1984

[51] Int. Cl.[4] ..... H01J 7/44

[52] U.S. Cl. ..... 315/49; 313/246; 313/355; 315/241 R

[58] Field of Search ..... 313/246, 355

[56] References Cited

U.S. PATENT DOCUMENTS

| | | | |
|---|---|---|---|
| 3,364,375 | 1/1968 | McCarty | 313/355 |
| 4,136,227 | 1/1979 | Saito | 313/346 R |
| 4,232,243 | 11/1980 | Rigden | 313/346 R |
| 4,518,890 | 5/1985 | Taguchi et al. | 313/346 R |
| 4,533,852 | 8/1985 | Frank et al. | 313/355 |

OTHER PUBLICATIONS

Vacuum Breakdown Observations on a W-$ThO_2$ Cerinet Cathode by Bouchard et al., 1970 Conference on Electron Device Techniques pp. 23, 24 Sep. 1970, New York.

*Primary Examiner*—Harold Dixon

*Attorney, Agent, or Firm*—John P. McMahon; Philip L. Schlamp; Fred Jacob

[57] ABSTRACT

A lighting unit having a filament serving as a supplementary light source, an improved gas discharge tube serving as a main light source having improved electrodes and an improved ballast circuit operating in cooperation with the improved electrodes is disclosed. Various embodiments of the improved electrodes and various embodiments of the improved ballast circuits are disclosed. The improved ballast circuit operating in cooperation with the improved electrodes provides for thermionic arc conditions in the operation of the gas discharge tube substantially immediately after the application of voltage applied to the unit.

16 Claims, 24 Drawing Figures

Fig. 3f
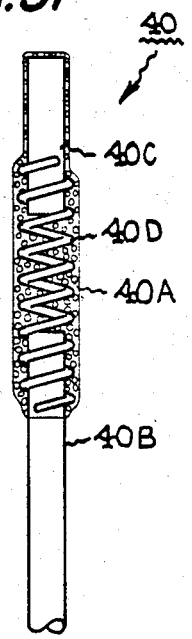
Fig. 3g
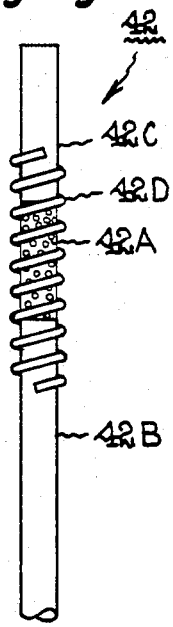
Fig. 3h
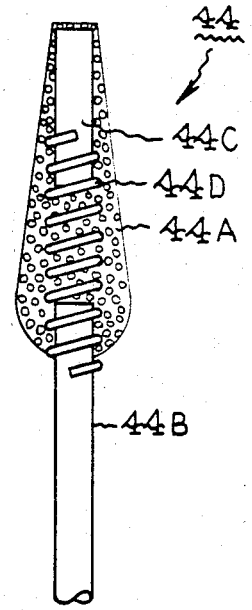
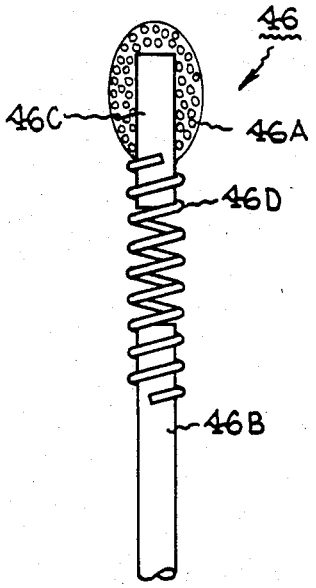
Fig. 3i
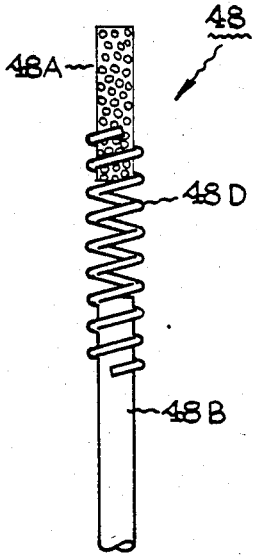
Fig. 3j

LIGHTING UNIT

BACKGROUND OF THE INVENTION

The present invention relates to an improved lighting unit. More particularly, the present invention relates to an improved lighting unit of the type incorporating a gas discharge tube and having improved electrodes effective for facilitating the starting of the gas discharge tube and an improved ballast circuit cooperating with the improved electrodes.

Recent improvements to the incandescent art have provided an improved lighting unit having a gas discharge tube as a main light source and also an incandescent filament as a supplementary light source. Such an improved lighting unit is generally disclosed in U.S. Pat. No. 4,350,930, of Peil et al, issued Sept. 21, 1982 and assigned to the same assignee as the present invention.

The gas discharge tube disclosed in U.S. Pat. No. 4,350,930 has various modes of operation such as (1) an initial high voltage breakdown mode, (2) a glow-to-arc transition mode, and (3) a steady state or run mode.

The run mode of operation of the gas discharge tube is considered the best mode for improving the operation of the lighting unit. During this run mode the electrodes within the gas discharge tube operate in a thermionic hotspot mode in which the electrodes are heated to thermionic temperatures so as to provide a thermionic arc and thusly supply the lighting unit with a high efficiency gas discharge tube serving as its main light source. It is desired that the improved lighting unit achieve this run mode as quickly as possible. This achievement is hindered in that the gas discharge tube is necessarily first sequenced through the glow mode in order to establish the run mode.

A ballast circuit of the improved lighting unit provides the necessary conditions to place the gas discharge tube into the glow mode. These conditions are a voltage having a typical value of 150 volts and a current having a typical value of 20 ma, both of which conditions serve to provide power to heat the electrodes of the gas discharge tube so that the electrodes attain and sustain the desired thermionic arc conditions required for transition into the run mode.

The power supplied to the gas discharge tube is supplied by an electronic ballast circuit which may be such as disclosed in the aforementioned U.S. Pat. No. 4,350,930. The voltage and current conditions applied to the gas discharge tube for the breakdown, glow, and run modes of operation are developed by a ballast circuit of the lighting unit. It is desired that the necessary voltage and current conditions for the gas discharge tube be reduced so that the implementation of the ballast circuit itself may be correspondingly reduced in size and simplified. One possible way of reducing size is to eliminate the glow mode operation of the gas discharge tube, which, in turn, allows the reduction of the number of circuit components needed.

Elimination of the glow mode is accomplished in the present invention by substantially improving the characteristics of the electrodes to achieve and sustain thermionic emission for the gas discharge and also by adapting the ballast circuit to the necessary operation of the improved electrodes. It is desired that electrodes be provided having improved characteristics so as to sustain a thermionic arc in the run mode without the need of first being preconditioned by glow mode operation.

If the glow mode operation is eliminated, a two-fold benefit is achieved in that (1) the implementation of the ballast circuit can be simplified, and (2) the improved lighting unit more quickly achieves its most beneficial mode of operation; namely, the run mode.

Accordingly, objects of the present invention are to provide (1) a gas discharge tube having electrodes with improved characteristics effective to sustain a thermionic arc in the run mode without first being preconditioned by the glow mode of operation, (2) a simplified ballast circuit adapted to the improved characteristics of the electrodes of the gas discharge tube, and (3) an improved lighting unit which quickly obtains its run mode of operation.

SUMMARY OF THE INVENTION

In accordance with the present invention an improved lighting unit having an improved electrode for a gas discharge tube and an improved ballast circuit operating in conjunction with the improved electrodes is provided.

The improved electrode is used in a gas discharge tube and is rendered thermionic in response to a ballast circuit. The ballast circuit comprises means for sequentially supplying to the improved thermionic electrode, (1) breakdown voltage in the range of about 300 volts to about 2000 volts, and (2) a run voltage in the range of from about 0 volts to about 170 volts, with limiting steady state currents in the range of about 0.3 amperes to about 0.6 amperes and with transient currents of about 100 amperes and about 10 amperes.

The improved thermionic electrode comprises a cermet material covering at least a portion of the electrode. The cermet material has a particle size in the range of from about 1.0 microns to about 50 microns and is comprised of a tungsten powder and a metal oxide having respective percent weight ratios in the range of 98 to 70 and 2 to 30. The metal oxide formed from a metal selected from the group consisting of scandium, aluminum, dysprosium, thorium, yttrium and zirconium and mixtures of the selected metals.

BRIEF DESCRIPTION OF THE DRAWING

FIGS. 3*a* through 3*j* show various embodiments of spot-mode electrodes in accordance with the present invention.

FIGS. 5*a* and 5*b* illustrate comparatively the operational response between prior art electrodes and spot-mode electrodes of the present invention.

DETAILED DESCRIPTION OF THE PREFERRED EMBODIMENTS

Figure 1:
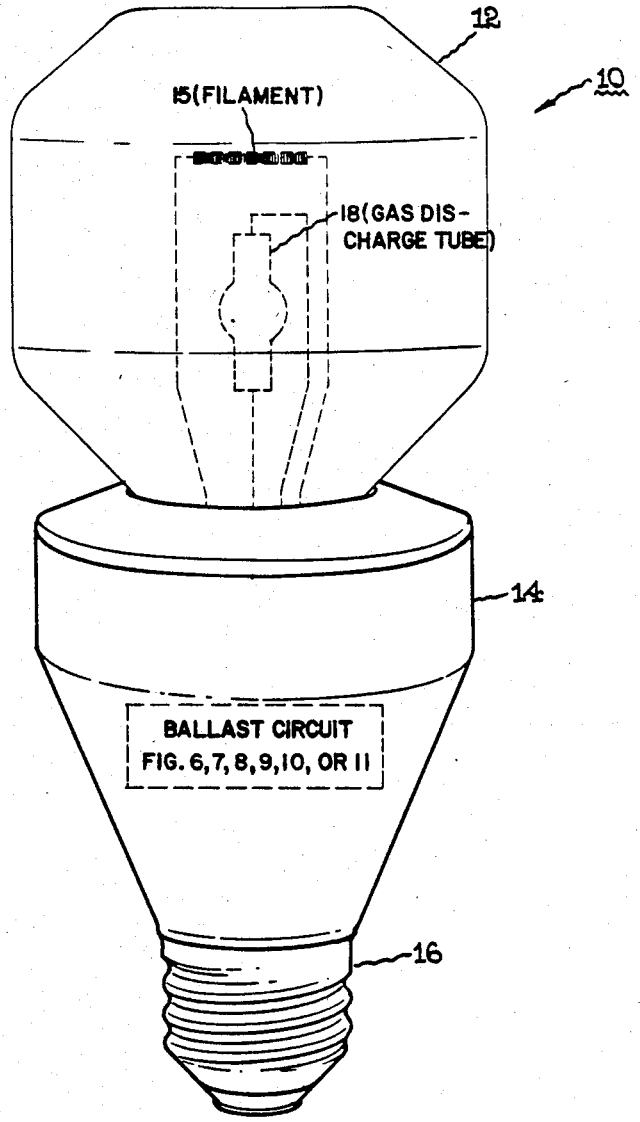
FIG. 1 shows a lighting unit in accordance with the present invention.

FIG. 1 shows a lighting unit 10 having a light-transmissive outer envelope 12. Spatially disposed in the outer envelope is a schematically shown gas discharge tube 18 which constitutes the main light source, and at least one filament 15 schematically shown which serves both as a supplementary light source and as a resistive element for the ballast circuit of the unit. The unit 10 has an electrically conductive base 16 and a housing 14 containing the electronic elements of the unit. FIG. 1 indicates that the housing 14 contains a resistive ballast circuit shown more clearly in FIGS. 6, 7, 8, 9, 10, or 11 each to be described hereinafter.

Figure 2:
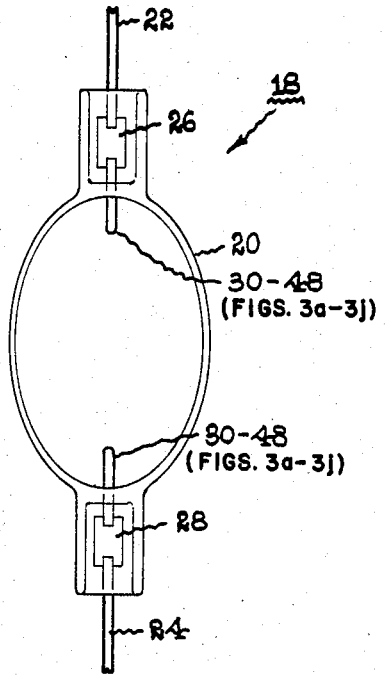
FIG. 2 shows a gas discharge tube in accordance with the present invention.

The gas discharge tube 18 of the lighting unit 10 is shown in detail in FIG. 2 and comprises a housing 20 which contains an inert gas such as argon having a fill-pressure in the range of about 10 to 500 torr. The housing 20 further contains (1) a metal selected from the group consisting of mercury and mercury cadmium amalgam and alloys thereof, and (2) a metal halide gas selected from the group of compounds of sodium iodide and scandium iodide.

The envelope 20 is formed of glass or quartz material. For a quartz envelope 20 outer leads 22 and 24 may have foil members 26 and 28 so as to provide a proper seal of outer leads 22 and 24 during the pinch sealing of the quartz envelope 20. For a glass envelope 20 the foil members 26 and 28 are not necessary during the pinching operation and the outer leads 22 and 24 may be of a solid rod-like structure.

FIG. 2 further shows the gas discharge tube 18 as comprising the electrodes 30–48 which are of substantial importance to the present invention and are herein termed spot-mode electrodes. Various embodiments of the spot-mode electrodes 30–48 are shown in FIGS. 3*a* through 3*j* with related elements indicated in Table 1.

TABLE 1

| SPOT MODE ELECTRODES | | |
|---|---|---|
| FIG. | TYPE | ELEMENTS |
| 3a | 30 | 30A |
| | | 30B |
| 3b | 32 | 32A |
| | | 32B |
| | | 32C |
| 3c | 34 | 34A |
| | | 34B |
| | | 34C |
| 3d | 36 | 36A |
| | | 36B |
| | | 36C |
| 3e | 38 | 38A |
| | | 38B |
| 3f | 40 | 40A |
| | | 40B |
| | | 40C |
| | | 40D |
| 3g | 42 | 42B |
| | | 42C |
| | | 42D |
| 3h | 44 | 44A |
| | | 44B |
| | | 44C |
| | | 44D |
| 3i | 46 | 46A |
| | | 46B |
| | | 46C |
| | | 46D |

The letter A of the elements given in Table 1 refers to a coating, the letter B refers to the shank portion, and the letter C refers to the tip portions of the electrodes of the various embodiments of FIGS. 3*a*–3*j*. The letter D refers to a wire formed of a tungsten material and comprising an element of the electrodes of FIGS. 3*f*–3*j*.

The elements of Table 1 having the letter A have typical characteristics given in Table 2.

TABLE 2

| Element | Length of the Coating | Thickness of the Coating |
|---|---|---|
| 30A | 1.5 mm | 0.25 mm |
| 32A | 1.0 mm | 0.25 mm |
| 34A | 1.0 mm | 1.0 mm |
| 36A | 1.0 mm | 1.0 mm |
| 38A | 1.5 mm | 0.4 mm tapered down to 0.025 mm |
| 40A | 1.8 mm | 0.25 mm |
| 42A | 0.5 mm | 0.23 mm |
| 44A | 1.5 mm | 0.4 mm tapered down to 0.025 mm |
| 46A | 1.0 mm | 0.25 mm |
| 48A | 1.0 mm | 0.23 mm |

The shank portion elements 30B, 32B, 36B, and 38B of Table 1, not having a coating of Table 2, have typical cylindrical dimensions of a diameter of about 0.3 mm and a length of about 0.5 mm.

The tip portion elements 32C, 34C, 40C, 42C, 44C, 46C, and 48A of Table 1 have typical cylindrical dimensions of a diameter of 0.3 mm and a length of 0.5 mm.

The tungsten wire elements 40D, 42D, 44D, 46D, and 48D have typical dimensions of a wire diameter of 0.18 mm, a wrapped length of 0.9 mm, and the distance between turns is 160% of the diameter of the portion being wrapped by the tungsten wire.

The elements 40C and 40B, 42C and 42B, 44C and 44B, 46C and 46B, 48A and 48B, are typically separated without touching each other in a coaxial manner by a distance of about 0.5 mm.

The elements having the subscript A are comprised of a tungsten and metal oxide cermet material. The tungsten and metal oxide cermet material placed on the electrodes facilitates the release of the electrons of the spot-mode electrodes from the metal of the electrodes so that the released electrodes are quickly delivered into the gas contained in the housing 20. The cermet material may be selected from Groups I and II of Table 3 with each group comprised of various ingredients given in ranges of weight percentage in Table 3 and having a typical particle size in the range of about 1.0 to about 50 microns.

TABLE 3

| | Composition | % by Weight |
|---|---|---|
| Group I | Tungsten Powder | 98 to 70 |
| | Scandium Oxide | 2 to 30 |
| Group II | Tungsten Powder | 98 to 70 |
| | Metal Oxide formed from metal selected from the group consisting of: Aluminum, Dysprosium, Thorium, Yttrium, Zirconium and mixtures thereof. | 2 to 30 |

The mixtures given in Table 3 may be formed by first admixing the various selected compositions of any of Group I, or II. The admixed cermet material is placed onto their desired locations shown in FIGS. 3a–3j and then sintered in hydrogen at an elevated temperature of about 1850° C. for a time duration of about 15 minutes. The sintered structure is mechanically strong, electrically conductive, and has a thermal conductivity significantly less than a solid rod formed of tungsten.

Figure 3A:
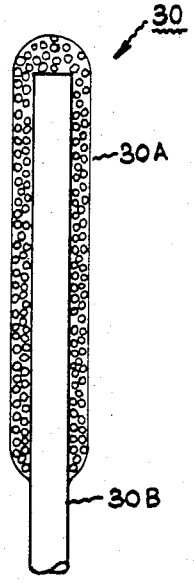
Figure 3B:
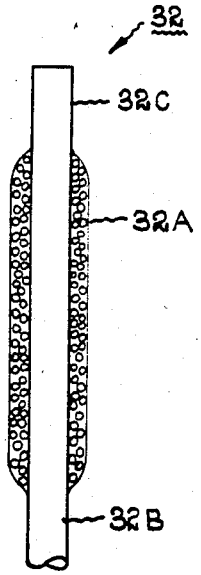
Figure 3C:
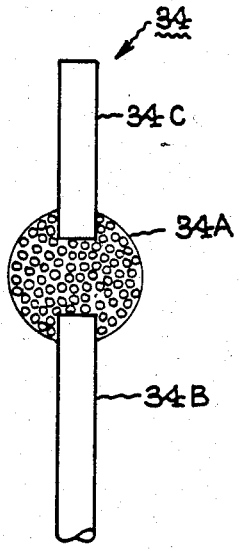
Figure 3D:
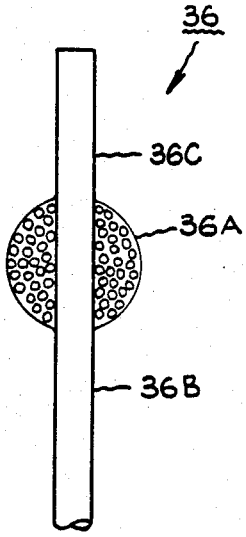
Figure 3E:
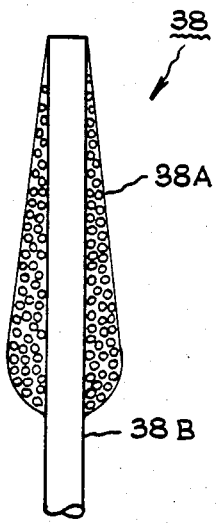
Figure 4:
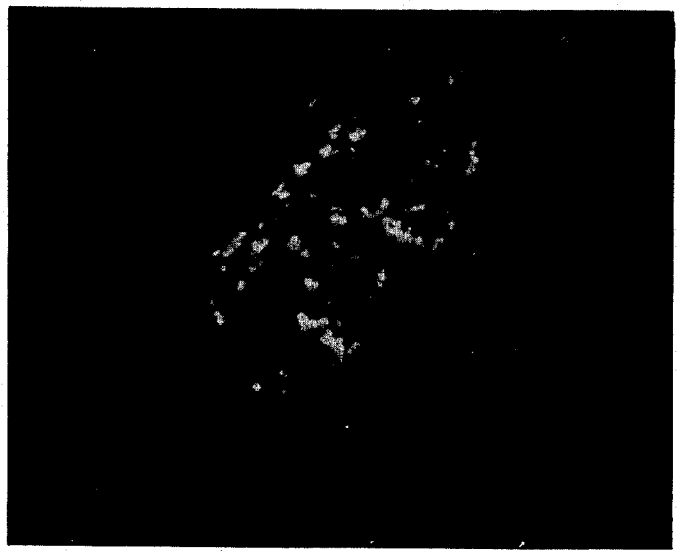
FIG. 4 is a Scanning Electron Microscope (SCM) micrograph of the cermet material of a spot-mode electrode of the present invention.

An electrode having a shape similar to electrode 30 of FIG. 3a and formed of a cermet material is shown in FIG. 4. FIG. 4 is a Scanning Electron Microscope (SCM) micrograph magnified fifty times showing one of the cermet materials of the present invention comprised of 85 parts per hundred of tungsten powder and 15 parts per hundred of the scandium oxide.

It should now be appreciated that the present invention provides for cermet materials of Table 3 that may be arranged or placed onto the spot-mode electrodes having various embodiments shown in FIGS. 3a–3j with various elements given and described for Table 1. The various electrode structures of the present invention achieve and maintain thermionic emission at a relatively low voltage.

The improved lighting unit 10 of FIG. 1 operating with an alternating current (A.C.) operating voltage for its ballast circuit utilizes a gas discharge tube of FIG. 2 having two spot-mode electrodes. For a direct current (D.C.) operating voltage of a ballast circuit of lighting unit 10, a gas discharge tube having at least one spot-mode electrode serving as its cathode is utilized.

The cermet material causes the tip portion of the spot-mode electrode to be particularly suited for supplying a plentiful source of electrons especially during the initial start-up operation of the improved lighting unit 10.

The spot-mode electrodes of the gas discharge tube 18 are such that when transient and limiting steady state currents, shown in FIG. 5(b) and developed by a ballast circuit (of FIGS. 6–11) all to be described hereinafter, are applied to the electrodes a voltage drop of less than about twenty-five (25) volts across the gas discharge tube 18, containing the previously given inert gas, vapor gas and halide, is maintained for the first few seconds of operation of the gas discharge tube 18. In order to understand more fully the improved starting of the spot-mode electrodes of the present invention, reference is made to FIG. 5a and 5b.

Figure 5B:
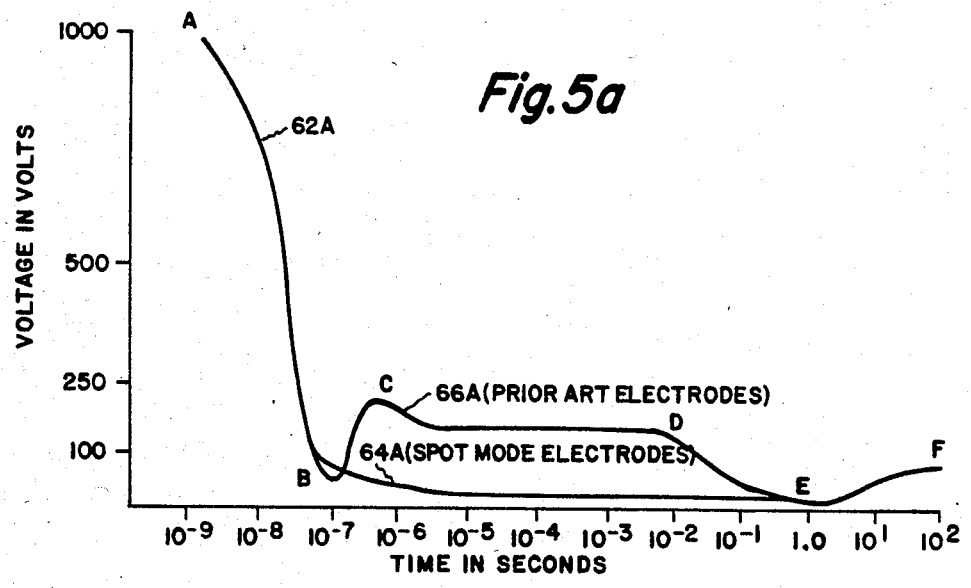

FIGS. 5a and 5b are interrelated, FIG. 5a being a plot of voltage versus time and FIG. 5b being a plot of current versus time both related to the operation of the spot-mode electrodes of the present invention and prior art electrodes.

Both FIGS. 5a and 5b have locations of interest A, B, C, D, E and F related to the operation of the spot-mode and prior art electrodes. Location A represents the initial application of voltage (FIG. 5a) and current (FIG. 5b) by the ballast circuit to the spot-mode electrodes of the present invention and prior art electrodes. Location B of FIG. 5a represents a transitional region wherein the intermediate voltage of the prior art electrodes reverts to a higher value whereas, the intermediate voltage of the present spot-mode electrodes remains at a relatively low value. The location B of FIG. 5b represents a transitional region wherein the intermediate current of the prior art electrodes rapidly decreases, whereas the intermediate current of the present spot-mode electrodes decays and then maintains a relatively high value of current. Locations C and D of FIGS. 5a and 5b represent the operational regions of response of the run mode of the present spot-mode electrodes shown by plot segments 64A (FIG. 5a) and 64B (FIG. 5b), whereas locations C and D of FIGS. 5a and 5b represent the operational regions of response of the glow mode of the prior art electrodes shown by a plot segment 66A (FIG. 5a) and 66B (FIG. 5b). Locations E and F of FIGS. 5a and 5b represents the regions of the run mode of operation of the prior art electrodes.

The overall operational response of the prior art electrodes is shown in FIGS. 5a and 5b wherein: (1) a relatively high voltage (FIG. 5a), such as 1000 volts, at a relatively low current (FIG. 5b) is initially applied (location A) causing but not sustaining an arc condition; (2) the initial voltage rapidly decays to a value of about 50 volts, whereas the initial current rapidly rises to as much as 100 amps (location B); (3) the voltage of the prior art electrodes then reverts rapidly to a high value of typically 250 volts, whereas, the current of the prior art electrodes reverts rapidly to a low value of about 10 milliamperes (location C); (4) the prior art electrodes are then maintained in their glow mode of operation (plot 66A), in a relatively constant manner, at a voltage value of about 160 volts and at a current value of about 80 ma both for a time duration of about 1 second, and, finally; (5) the prior art electrodes transition to their run mode wherein the voltage value drops to about 20 volts and the current value rises to as much as 800 ma.

The overall response of the spot-mode electrodes of the present invention is quite different from that of the prior art electrodes in that (1) after the initial application of the relatively high voltage of about 1000 V, the voltage decays to a relatively low value of about 20 volts and unlike the prior art electrodes this relatively low voltage value is maintained by spot-mode electrodes (plot 64A), and, similarly unlike the prior art electrodes the spot-mode electrodes of the present invention, (2) after the initial application of the relatively low ionization current the current rises (plot 62B) and then the transient current having an initial peak of about 100 amperes decays to a relatively high value of about 10 amperes, and further unlike the prior art electrodes, (3) the relatively high current value is substantially maintained by the spot-mode electrodes. The current related to the spot-mode electrodes drops from about 10 amperes to about 800 milliamperes after about 50 milliseconds and substantially maintains that value until reaching location E of FIG. 5(b). The current then falls to its steady state value of about 350 milliamperes marked as location F.

The relatively high current of 100 amperes shown in FIG. 5(b) for both the prior art electrodes and the spot-mode electrodes of the present invention is not an unusually large amount and is typically realized when an energy storage device, such as a charged capacitor is suddenly discharged within a fraction of a microsecond, such as $10^{-7}$ seconds, directly into the gas discharge tube. The 10 amperes of current typically seen and related to plot 64B of FIG. 5(b) is due to the warm-up characteristics of the incandescent filament. As shown in FIG. 5(b) the high current condition of 100 amperes and 10 amperes are short-lived or transient and as such are not destructive to either the gas discharge tube 18 nor to the filament 15.

The primary difference of the present invention relative to prior art electrodes which is of substantial importance is that the spot-mode electrodes of the present invention are not characterized by a glow mode of operation. The elimination of the glow mode allows the improved lighting unit of the present invention advantageously to attain its run mode of operation in a rapid manner. The elimination of the glow mode is further advantageous in that it permits simplification of the ballast circuit of the present invention in accordance with the various embodiments shown in FIGS. 6–11.

Figure 5B:
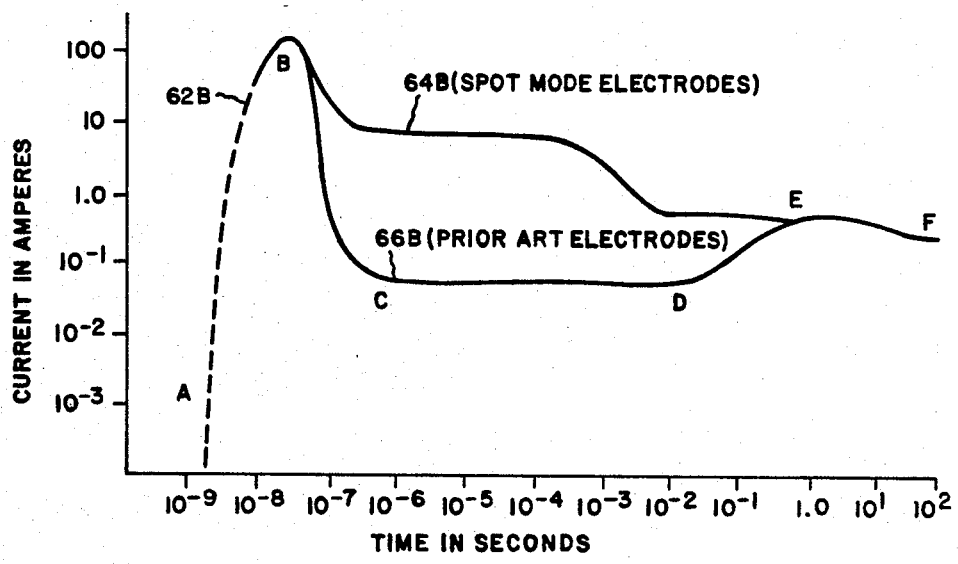

The ballast circuits of FIGS. 6–11 comprise means for sequentially supplying to the improved thermionic electrode (1) breakdown high voltage in the range of about 300 volts to about 2000 volts; and (2) a run voltage in the range of about 0 volts to about 170 volts at a steady state current in the range of 0.3 ampere to about 0.6 ampere with transient currents of about 100 amperes and about 10 amperes as indicated in FIG. 5(*b*).

In general, the various ballast circuits of FIGS. 6 through 11 are comprised of cascaded diode-capacitor voltage doublers which provide breakdown voltage and cooperate with two (2) separate lamp filaments; one filament to provide for instant light during hot restart and the other filament to provide current limiting and instant light during warm-up.

The voltage multiplier circuits of FIGS. 6–11 develop the breakdown voltage which initiates the thermionic arc condition of the gas discharge tube 18. The ballast circuits further comprise current sustaining means for continuing to supply current to the gas discharge tube, for a predetermined duration, which is limiting steady state currents in the range from about 0.3 to about 0.6 amperes occurring after the initiated thermionic arc condition of the gas discharge tube, and are of a transient type as indicated in FIG. 5(*b*).

Figure 6:
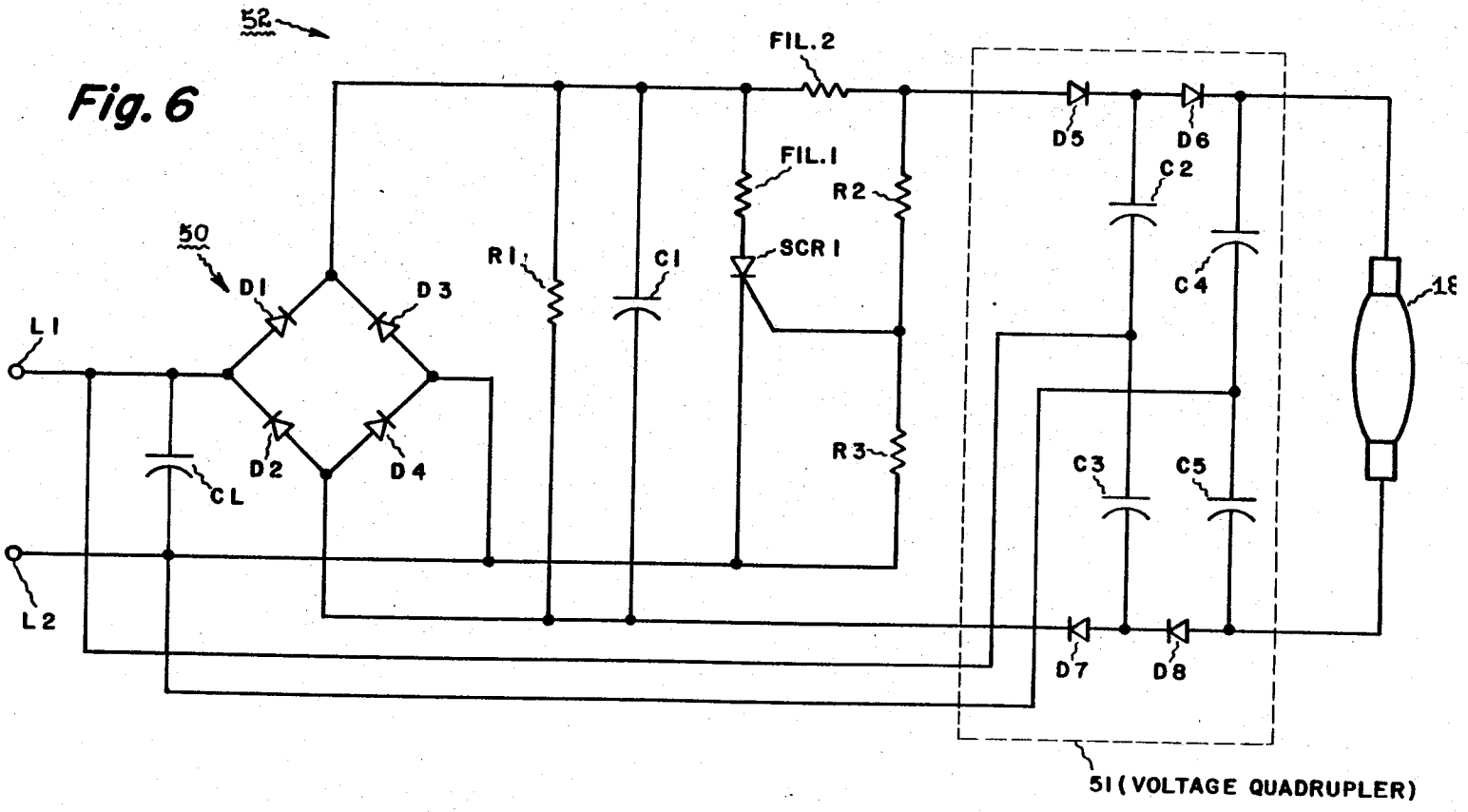
FIGS. 6 through 11 show ballast circuit arrangements in accordance with various embodiments of the present invention.

The first embodiment of the ballast circuit of the present invention is shown in FIG. 6. FIG. 6 shows a plurality of elements having a value or of the type given in Table 4.

TABLE 4

| Element | Value or Type |
|---|---|
| D1, D2, D3, D4, D5, D6, D7 and D8 | IN4007, 1 AMP, 1000 PIV |
| R1 | 100 K ohms |
| R2 | 330 K ohms |
| R3 | 1 K ohms |
| CL | 0.002 uf |
| C1 | 50 uf |
| C2 | 0.03 uf rated at 600 volts |
| C3 | 0.03 uf rated at 600 volts |
| C4 | 0.03 uf rated at 400 volts |
| C5 | 0.03 uf rated at 400 volts |
| FIL 1 | tungsten filament |
| FIL 2 | tungsten filament |

The circuit arrangement 52 of FIG. 6 having the elements of Table 4 has a capacitor CL connected across input terminals L1 and L2 which serves to reduce the electromagnetic interference (EMI). The circuit arrangement 52 further has diodes D1, D2, D3, and D4 arranged into a full-wave rectifier 50 as shown in FIG. 6. The full-wave rectifier 50 has connected across its first and second output nodes a filter arrangement comprised of resistor R1 and capacitor C1.

The circuit arrangement 52 has two filaments FIL 1 and FIL 2. Filament FIL 1 provides for instant light for the lighting unit 10 during the conductive condition of the silicon control rectifier SCR1, whereas, the filament FIL 2 provides for instant light for the lighting unit 10 and a resistive element for the gas discharge tube 18 both independent of the conductive state of SCR1. The filament FIL 1 is coupled into and out of the operational response of the circuit arrangement 52 by the conductive and nonconductive states, respectively, of the silicon controlled rectifier SCR1. The states of SCR1 are determined by a voltage divider network comprised of serially connected resistors R2 and R3 having its node connected to the gate electrode of SCR1. The SCR1 is rendered conductive when the voltage across resistor R3, which is connected across the cathode and gate of SCR1, rises to provide turn-on gate current typically in the order of 200 microamperes. The conductive SCR1 provides the path for connecting filament FIL 1 between the output node of the full-wave rectifier 50 common with R1 and C2, and the terminal L2. Conversely, when the SCR1 is in its nonconductive state, filament FIL 1 is effectively decoupled from the circuit arrangement 52.

In a manner unlike FIL 2, the filament FIL 2 is arranged in the circuit of arrangement 52, as shown in FIG. 6, so as to provide a resistive ballasting element continuously in series with the gas discharge tube 18.

The circuit arrangement 52 further comprises a voltage quadrupler 51 comprised of diodes D5, D6, D7, D8, and capacitor C2, C3, C4 and C5. The anode of diode D5 is connected to one side of the filament FIL 2 and the cathode of diode D5 is connected to the anode of diode D6, which, in turn, has its cathode connected to one side of the gas discharge tube 18. The other side of the gas discharge tube 18 is connected to the anode of diode D8, which, in turn, has its cathode connected to the anode of diode D7, which, in turn, has its cathode connected to the second output node of the full-wave rectifier 50 as shown in FIG. 6.

The capacitors C2 and C3 are connected serially and similarly capacitor C4 and C5 are connected serially. The serially arranged capacitors C2 and C3 are connected between the cathode of diode D5 and the anode of diode D7, whereas, the serially arranged capacitors C4 and C5 are connected between the cathode of diode D6 and the anode of diode D8. The node formed by capacitors C2 and C3 is connected to terminal L1, whereas, the node formed by capacitors C4 and C5 is connected to terminal L2.

In operation, the voltage quadrupler 51 of circuit arrangement 52 provides for about 600 volts for the breakdown mode of the gas discharge tube and also provides about 30 amps of current for about 0.5 microseconds immediately after the breakdown of the gas discharge tube 18. When the voltage on the discharge tube supplied by the quadrupler 51 after breakdown drops to a value below about 168 volts, the energy stored in capacitor C1 begins to furnish current to the gas discharge tube 18 through the ballasting filament FIL 2. During this condition, the value of the current peaks supplied by the power line, that is, the voltage across terminals L1 and L2 is approximately 10 amps and remains as such until the voltage across the gas discharge tube 18 starts to rise and the resistance of the filament FIL 2 increases to its operating condition, whereby the average current derived from the power line voltage settles at a value of about 350 milliamperes which is sufficient to maintain the thermionic emission condition of the hereinabove described spot-mode electrodes of FIGS. 3*a*–3*j*.

The circuit arrangement 52 provides the necessary voltage and current conditions such as to maintain the thermionic emission conditions of the spot-mode electrodes of FIGS. 3*a*–3*j*. The circuit arrangement 52 is advantageous in that it allows the spot-mode electrodes to achieve their steady-state thermionic emission with relatively low voltage levels. However, the circuit arrangement 52 has somewhat of a limitation in that it only supplies a relatively low voltage of 600 volts to initiate the breakdown mode on the gas discharge tube. The limitation of the circuit arrangement 52 is not as severe in the circuit arrangement of 54 shown in FIG. 7.

The circuit arrangement 54 is generally the same as circuit arrangement 52 but differs from the circuit arrangement of 52 in essentially two ways: (1) the circuit arrangement 54 has a voltage quadrupler 53, connected to the gas discharge tube 18 through an isolating impedance R4 which substantially eliminates the 100 ampere surge current, and (2) the circuit arrangement 54 only has one filament, that is, FIL 1, and allows the filament FIL 1 to act both for instant light conditions and for ballasting considerations of the gas discharge tube 18.

The filament FIL 1 acting in its dual capacity provides instant light and limits the current furnished by both the capacitor C1 and the line voltage applied across terminals L1 and L2. The filament FIL 1 is serially arranged with the gas discharge tube 18, via diode D5, and has one of its ends connected to the anode of the SCR1. The SCR1, in a manner as described for the circuit arrangement 52, when rendered conductive provides a low impedance path for current flowing through the filament initiating at one output node of the full-wave rectifier 50 and returned to terminal L2, thereby providing immediate light during hot restart.

Figure 7:
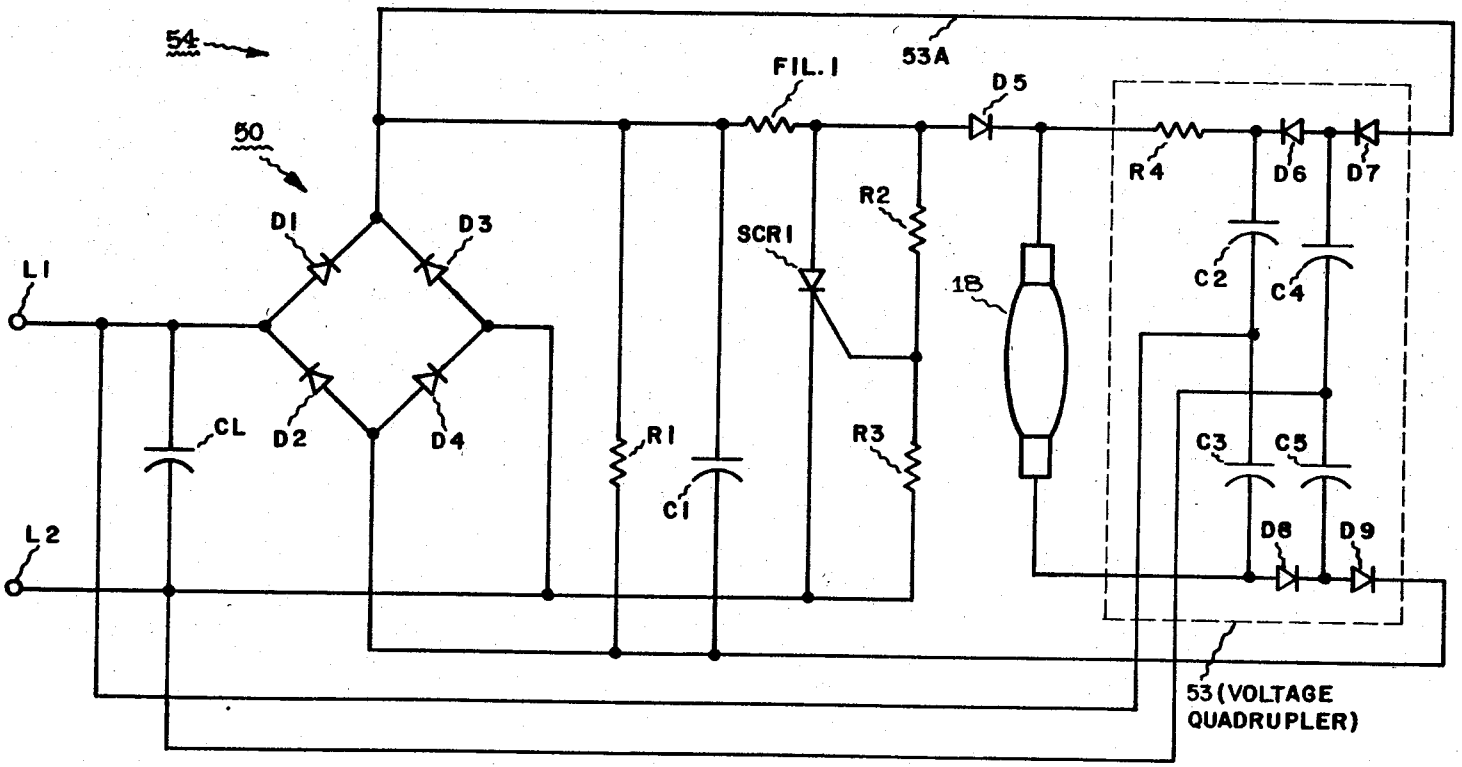

The voltage quadrupler 53 of FIG. 7 has an arrangement different from that of voltage quadrupler 51 of FIG. 6 in that (1) a path 53A directly connects, via diode D7, the voltage quadrupler 53 to the first output node of the input full-wave rectifier, (2) the gas discharge tube 18 is arranged within voltage quadrupler 53 to have one of its ends connected to diode D5 and path $53_A$, via serially arranged resistor R4 and forward conducting diodes D6 and D7, and its other end connected to the second output node of the full-wave rectifier via forward conducting diodes D8 and D9.

The impedance isolation between the voltage quadrupler 53 and the gas discharge tube is supplied by resistor R4 which has a typical value of 200 K Ω and is inserted between diodes D5 and D6 so as to suppress the 100–30 ampere current spikes typically occurring during a gas discharge tube 18 energization. The resistor R4 also increases the discharge time constant of voltage quadrupler 53 relative to that of voltage quadrupler 51. The circuit arrangement is advantageous in that it allows the quadrupler capacitors to discharge more slowly and enables the spot-mode electrodes of FIGS. 3*a*–3*j* to achieve their steady-state thermionic emission and provides suppression of current surges to the gas discharge tube 18.

The ballast circuit 54 supplies about 170 volts D.C. for a duration of about 100 milliseconds which occurs after the initial breakdown mode. However, the use of only a single filament, while simpler than the arrangement of circuit 52, has somewhat of a shortcoming wherein current flowing through the filament FIL 1 providing instant light during starting, is therefore not available to the gas discharge tube 18 and prevents the gas discharge tube 18 from assuming its desired arc discharge condition. This undesirable situation is remedied by the circuit arrangement 56 of FIG. 8.

The circuit arrangement 56 is generally the same as circuit arrangement 54 but differs from the circuit arrangement 54 by having (1) the filament FIL 2 and FIL 1 in its arrangement with SCR1 both described for circuit arrangement 52, and (2) one end of the gas discharge tube 18 provided with an additional path to the second output node of the full-wave rectifier 50 through diode D8.

The additional path provided by diode D8 causes the voltage of capacitor C1 to be added to that of the quadrupler 55. The circuit arrangement 56 further provides for capacitors C2, C3, C4 and C5 of essentially double the value, such as 0.06 uf rated at 600 volts, of that of the capacitors C2, C3, C4 and C5 of quadruplers 51 and 53, of circuit arrangement 52 and 54, respectively.

In operation, the circuit arrangement 56 allows the gas discharge tube 18 to initiate and maintain the thermionic emission of its spot-mode electrodes in the run mode in a more reliable manner than that of either circuit arrangements 52 or 54. The more reliable operation of circuit arrangement 56 is provided, in part, by the increased values of capacitors C2, C3, C4 and C5 and the addition of diode D8 developing a voltage for the high voltage breakdown mode in the order of 750 volts D.C. and also developing a voltage for the run mode in the order of 150 volts. The circuit arrangement 56 has somewhat of a limitation in that it supplies only approximately 750 volts to initiate the breakdown for the gas discharge tube 18. This limitation is avoided by the circuit arrangement 58 as shown in FIG. 9.

Figure 8:
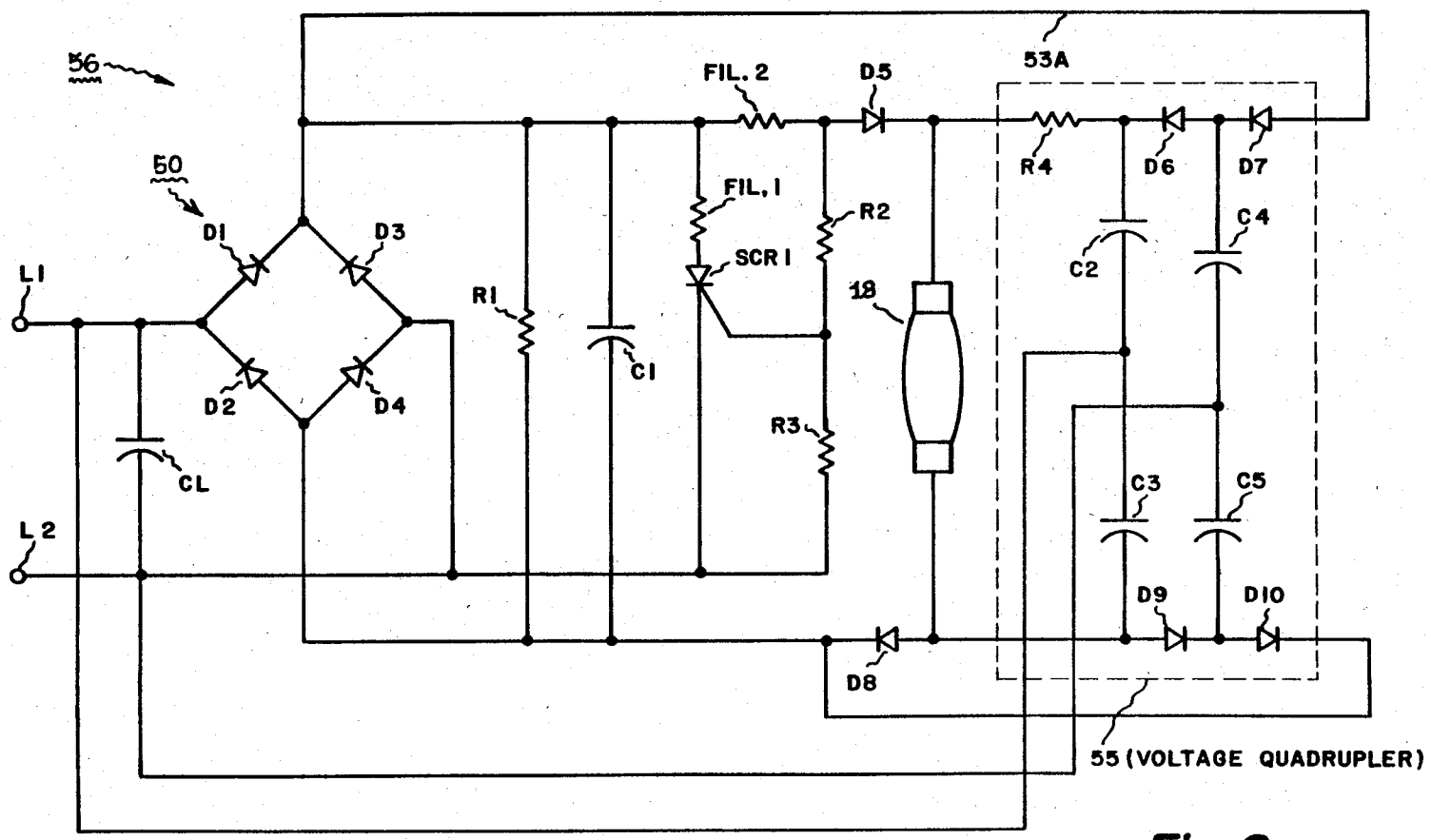
Figure 9:
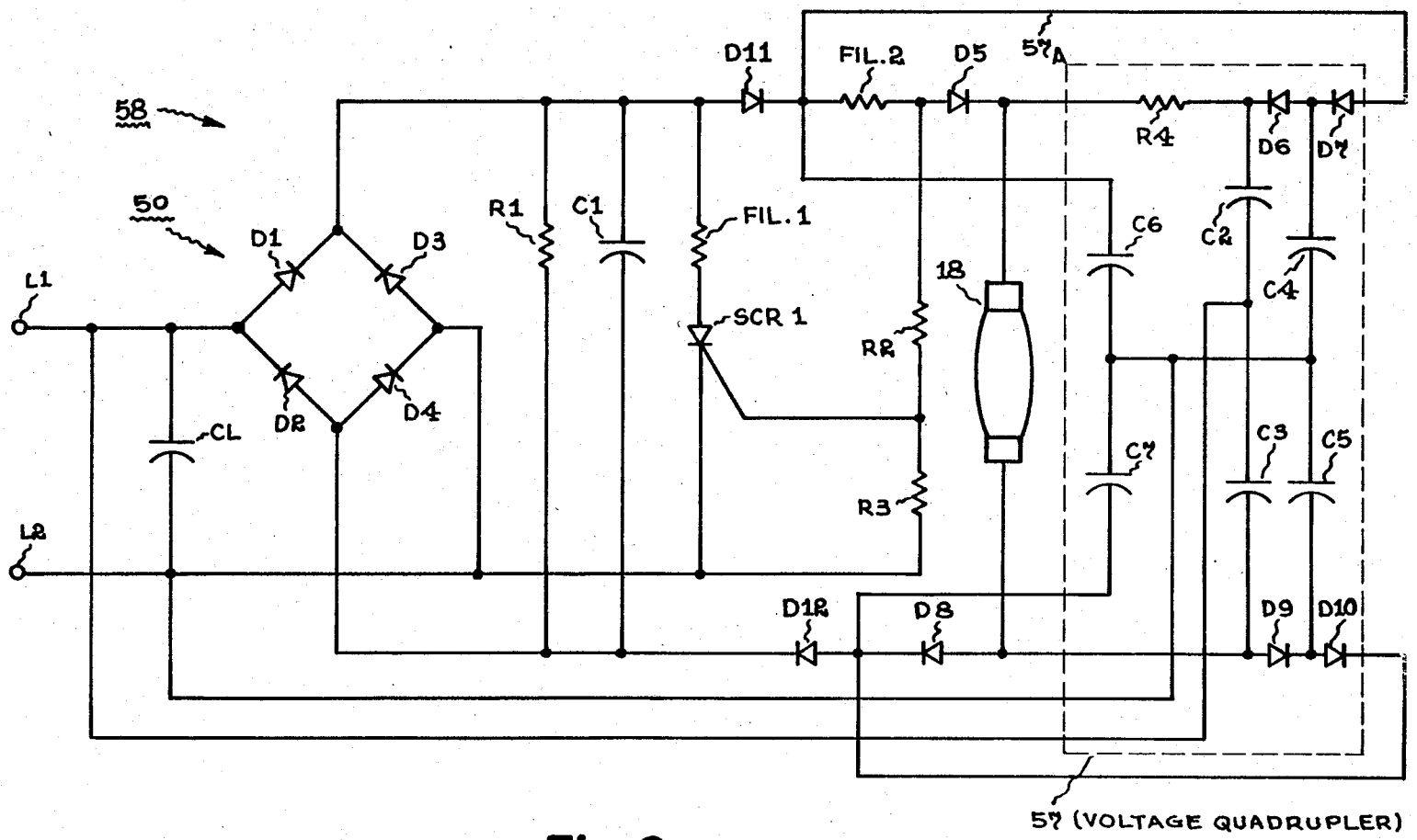

The circuit arrangement 58 of FIG. 9 is generally the same as circuit arrangement 56 but differs from circuit arrangement 56 of FIG. 8 in that, (1) a path $57_A$ connects diode D7 to filament FIL 2, (2) a forward conducting diode D11 is interposed between filament FIL 2 and the first output node of the full-wave rectifier, (3) additional capacitors C6 and C7 each having a typical value of 1 uf, are serially arranged within voltage quadrupler 57 with each other and the serial arrangement is connected between the cathode of diode D11 and the anode of an added diode D12 which has its cathode connected to the second output node of the full-wave rectifier.

The circuit arrangement 58 provides a relatively high breakdown voltage of about 1070 volts to the gas discharge tube 18 and also provides for starting current flow through two successive current paths of R4 and FIL 2 to be described hereinbelow. The circuit arrangement 58 is such as to provide the 1070 volts by summing the voltages provided by three sources (1) 600 volts provided by C2, C4, C5, and C5 of the previously described quadrupler; (2) 300 volts provided by C6 and C7 of the added voltage doubler; and (3) 170 volts provided from the capacitor C1 arranged across the full-wave rectifier 50.

Prior to breakdown, approximately 1070 volts is present across the gas discharge tube 18, and diodes D5, D8, D11, and D12 are back-biased except for a special condition related to D11, discussed below. When breakdown of the gas discharge tube 18 occurs, current starts to flow through R4, which is one of the current paths through the gas discharge tube 18, and the voltage provided by the quadrupler 57 decays. When the voltage across the gas discharge tube decays to 450 volts, diodes D11 and D12 are still back-biased, but D5 and D8 are no longer back-biased and current then flows through the gas discharge tube 18 via an alternate path which includes FIL 2. When the voltage provided by the doubler has decayed, diodes D11 and D12 are no longer back-biased and current to maintain the gas discharge tube 18 in the run mode is thereafter provided by capacitor C1 arranged across the full-wave rectifier 50 via diodes D11, D12 and filament FIL 2.

The circuit arrangement Of FIG. 9 further prOvides for control of instant light FIL 1 via SCR1 as described previously for circuit arrangement 52 in FIG. 6 with the additional condition that during the positive half-cycle of the power line, meaning L1 positive relative to L2, a small amount of current flows through diode D11 sufficient to provide turn-on bias for SCR1.

The present invention in addition to the described ballast circuits 52, 54, 56, and 58, further contemplates the use of a ballast circuit disclosed in the previously mentioned U.S. Pat. No. 4,350,930 for developing a D.C. operating signal for a gas discharge tube preferably having a single spot-mode electrode serving as the cathode. Further, this invention contemplates the use of a ballast circuit for developing a D.C. operating voltage for the gas discharge tube having a single spot-mode electrode serving as the cathode that utilizes time pulsed additions (TPA) as described in U.S. patent application Ser. No. 538,246, of Leskovec et al., filed Oct. 3, 1983 and assigned to the same assignee as the present invention. Still further, this invention contemplates the use of a ballast circuit for developing an A.C. operating voltage for the gas discharge tube having two spot-mode electrodes (serving alternately as anode and cathode) that utilizes A.C. TPA as described in the aforementioned U.S. patent application, Ser. No. 538,246.

The present invention also contemplates the use of a ballast circuit for developing an A.C. operating voltage for the gas discharge tube having two spot-mode electrodes (serving alternately as anode and cathode) by operating it from an A.C. bridge circuit which is, in turn, supplied with high-voltage D.C. for starting, and D.C. TPA for sustaining the subsequently established run condition.

Figure 10:
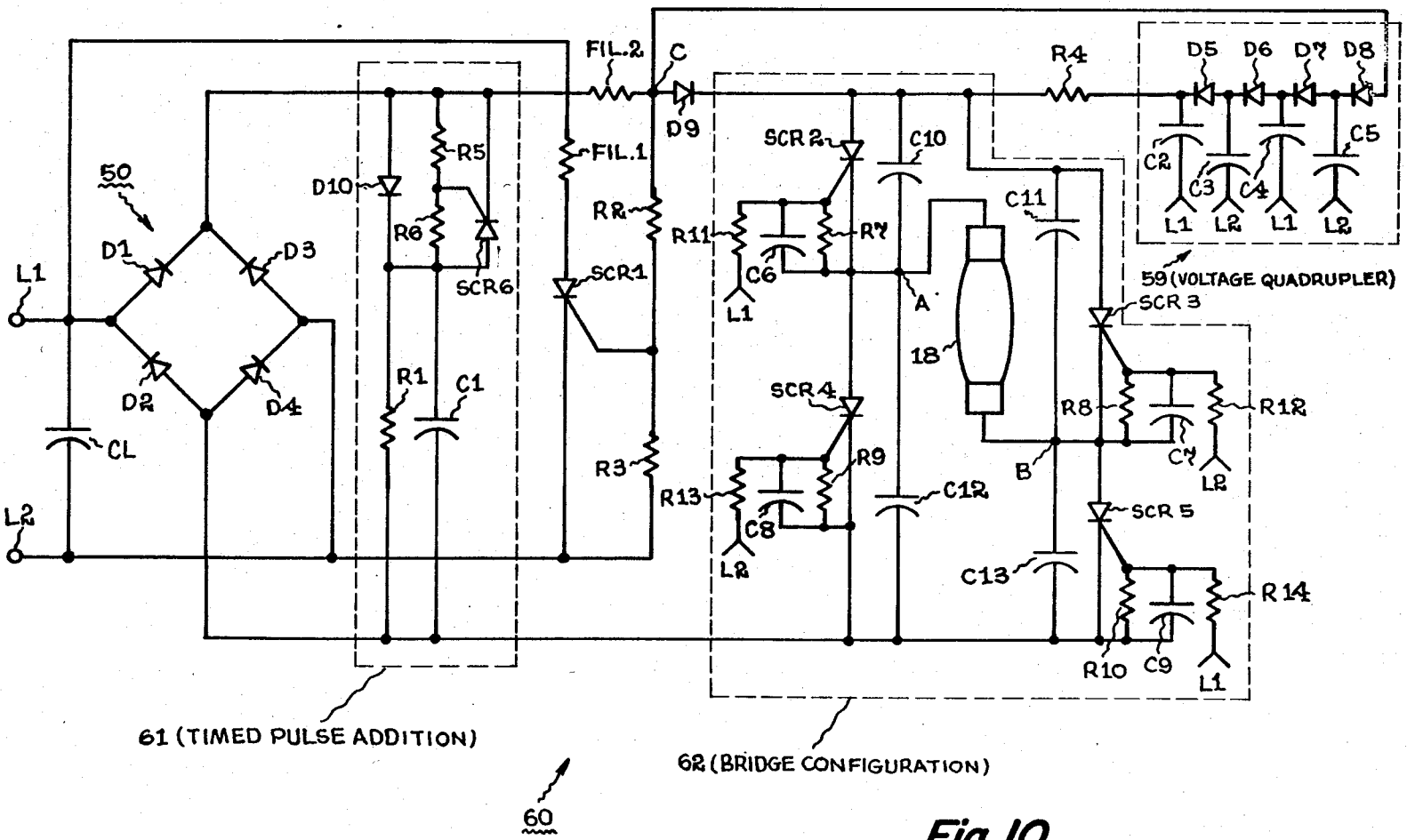

An embodiment of such a circuit is shown in FIG. 10 with a plurality of elements having a value or type as given in Table 6.

TABLE 6

| Element | Value or Type |
|---|---|
| D1 through D10 | Diode, 1 Amp, 1000 PIV, IN 4007 |
| R1 | 100 K ohms |
| R2 | 330 K ohms |
| R3, R5 | 1 K ohms |
| R4 | 220 K ohms |
| R6 | 130 K ohms |
| R7, R8, R9, R10 | 1.3 K ohms |
| R11, R12, R13, R14 | 51 K ohms |
| CL | 0.002 uf, rated at 500 volts |
| C1 | 10 uf, rated at 180 volts |
| C2 through C13 | 0.005 uf, rated at 1000 volts |
| SCR1 through SCR6 | MCR100-8, 600 volts (Motorola) |
| FIL 1, FIL 2 | Tungsten filament |

Figure 11:
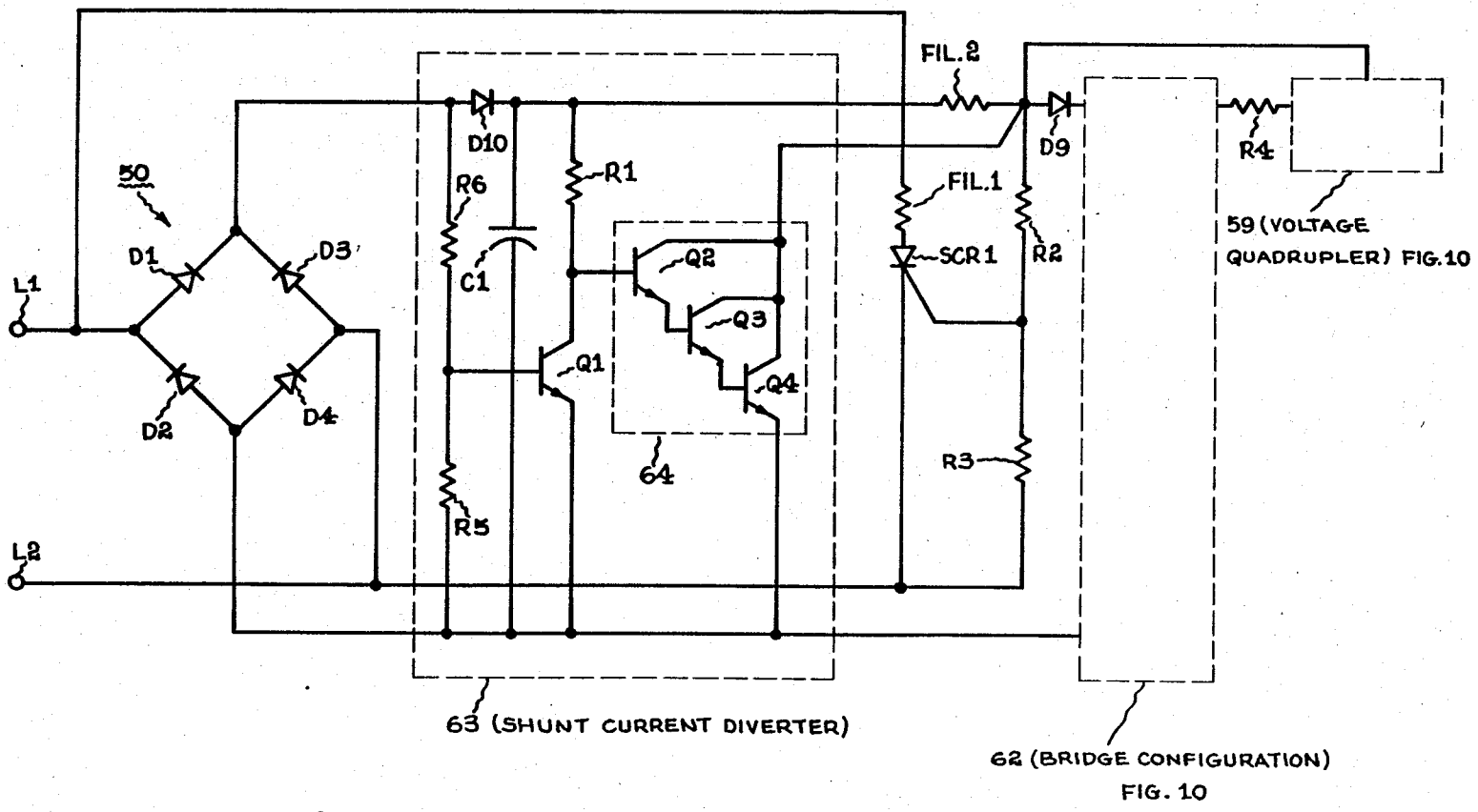

The circuit arrangement 60 of FIG. 10 having the elements of Table 6 includes a capacitor CL and diode bridge rectifier 50 formed by D1, D1, D3, and D4 as described previously for the circuit in FIG. 6. The circuit arrangement 60 has two filaments, FIL 1 and FIL 2. Filament FIL 1, and components SCR1, R2, and R3, form an instant light circuit as described previously for the circuit arrangement 52. One end of the filament FIL 1 of FIG. 10, and also of FIG. 11 to be described, is connected directly to terminal L1 of the A.C. line to avoid disturbing the operation of circuit 61 in FIG. 10 and circuit 63 in FIG. 11. Filament FIL 2 of FIG. 10 and also of FIG. 11 provides a resistive ballasting element for the gas discharge tube 18. The circuit arrangement 60 of FIG. 10 is shown as having a plurality of junctures L1 and L2 which are meant to represent that these junctures are interconnected to the input terminals L1 and L2, respectively.

The circuit arrangement of FIG. 10 has a timed pulse addition (TPA) network 61 arranged across the output nodes of the full-wave rectifier 50 and further arranged to render the switching means SCR6 conductive at a predetermined portion of the applied A.C. signal. The network 61 has a capacitor C1 with a value, such as 10 microfarads, small enough so that the capacitor C1 discharges sufficiently by the end of the half-cycle of the A.C. source 12 in order that the voltage across the gas discharge tube falls below the extinction potential of the gas discharge, thereby allowing the current to cease flowing through the gas discharge tube 18 and the SCRs in the bridge 62 to be described, to cease conduction. The 10 microfarads capacitor C1 is a typical value for the type and current rating of the gas discharge tube 18, as well as operating 60 Hz of the A.C. source 12. The value of capacitor C1 is less than 10 microfarads for higher frequencies of the A.C. source 12.

The circuit arrangement 60 of FIG. 10 and also circuit arrangement 66 of FIG. 11 provide an operation wherein the starting of the spot-mode electrodes is eased allowing for low energy starters such as voltage multipliers having relatively low values of capacitors. Low energy starting voltage multipliers are inherently D.C. in their operation so as to hinder their usage in A.C. voltage applications shown in FIGS. 10 and 11. The present invention comprises a polarity-reversing bridge configuration circuit 62 shown in FIGS. 10 and 11 which, as is to be described, provides for direct current (D.C.) to start the operation of the A.C. type gas discharge tube 18.

The circuit arrangement of FIG. 10 has a bridge configuration network 61 having a plurality of switching means arranged with respective capacitor and further arranged into pairs to be conductive at a predetermined portion of the applied A.C. signal. The conductive pairs of switching means are serially arranged with the gas discharge tube 18. The circuit arrangement of FIG. 10 further comprises a voltage quadrupler circuit 59 which operates in a manner similar to the voltage multiplier circuits of FIGS. 6–9 to develop the breakdown voltage which initiates the thermionic arc condition of the gas discharge tube 18.

The circuit arrangement 60 includes (1) a D.C. timed pulse addition (TPA) circuit 61 of a type similar but not limited to the type discussed in the aforementioned patent application Ser. No. 538,246; (2) an output polarity reversing circuit comprised of SCR (silicon controlled rectifier) devices SCR2, SCR3, SCR4 and SCR5 arranged in a bridge configuration 62; and (3) a half-wave voltage quadrupler 59 comprised of diodes D5, D6, D7, D8, which are respectively arranged with capacitors C2, C3, C4, and C5.

The gas discharge tube 18 is situated within the bridge configuration 62 of the SCR devices such that commutation (turning on and off) of the SCR switching elements SCR2, SCR3, SCR4 and SCR5 in appropriate pairs causes the current flowing through the gas discharge tube 18 to periodically reverse, even though the current supplying the bridge circuit remains as direct current. For example, when pair SCR2 and SCR5 are conducting and pair SCR3 and SCR4 are nonconducting, current flows through the gas discharge tube 18 from terminal A to terminal B as shown in the circuit arrangement 62. Conversely, when pair SCR3 and SCR4 are conducting, and pair SCR2 and SCR5 are nonconducting, current flows through the gas discharge tube 18 from terminal B to terminal A of circuit 62.

Each of the four SCR devices SCR2 . . . SCR5 in the bridge configuration 62 are arranged with a respective biasing network such as R10, C9, and R14 shown as arranged with SCR5. Further, each of the SCR2 . . . SCR5 are connected to an appropriate side of the A.C. supply line so as to be made conductive at the proper time. For example, the gate of SCR5 is connected to a node formed by the connection of resistor R10, capacitor C9, and resistor R14. The other end of R10 and C9 are connected to the cathode of SCR5. The cathode of SCR5 is connected, through diode D4 of the full-wave rectifier 50, to terminal L2 of the A.C. line. The other end of resistor R14 is connected to terminal L1 of the A.C. line.

In the operation of SCR5 when the A.C. line goes positive (L1 relative to L2), current flows through R14 so as to render SCR5 conductive and cause it to conduct current in the direction of anode to cathode. Capacitor C9 filters the gate signal applied to SCR5 and acts as a transient suppression device to prevent accidental triggering of SCR5. Capacitor C13 is connected from anode to cathode of SCR5 so as to prevent fast rate-of-change (dV/dT) anode voltage triggering of SCR5. The hereinbefore discussion of SCR5 and its related network components is equally applicable to the other SCR devices SCR2, SCR3 and SCR4 each having corresponding components as shown in FIG. 10.

It should now be appreciated that when the A.C. line goes positive, L1 relative to L2, SCR2 and SCR5 are triggered into their conducting states causing current to flow through the gas discharge tube 18 from terminal A to B. Conversely, when the A.C. line goes negative, L1 relative to L2, the polarity is such that L2 is positive relative to L1, such that SCR3 and SCR4 are triggered into conduction causing the current through the gas discharge tube 18 to now pass in the direction from terminal B to terminal A.

It should be noted that in U.S. Pat. No. 4,042,856 of Steigerwald assigned to the same assignee of the present invention, the use of polarity-reversing bridge circuits for the operation of gas discharge lamps in the A.C. mode has been previously disclosed. However, U.S. Pat. No. 4,042,856 does not disclose the use of SCR devices, nor any means, to interrupt the current to allow the SCR devices to turn-off. It should be further noted, that SCR devices, such as those disclosed in the present invention, have a characteristic of remaining in the conductive state once triggered, unless the current flowing through the SCR devices is interrupted. Except for the provision of this invention, if the SCR devices were used in their known manner, the basic bridge circuit 62 of FIG. 10 would latch-up after undergoing one cycle of the A.C. line.

This latch-up situation is remedied by the implementation of three separate and different circuit operations each having their own advantage (1) the use of TPA (similar to the previously mentioned U.S. patent application Ser. No. 538,246) in combination with a capacitor C1 of the TPA circuit 61 of FIG. 10 of sufficiently small enough value so that the gas discharge tube 18 and the SCRs of the bridge configuration 62 drop out before the end of the half-cycle due to lack of sustaining energy; (2) the use of a conventional full-wave bridge rectifier 50 with nominal 50 uF storage capacitor C1 of FIG. 11 to produce a continuous steady D.C. waveform for the SCR bridge configuration circuit 62 thereby supplying a desirable square A.C. waveform to the gas discharge tube 18, with the addition of a shunt current diverter 63 which diverts the current momentarily and periodically away from the bridge of the configuration circuit 62 to provide proper turn off; and (3) the use of a conventional full-wave bridge rectifier 50 with nominal 50 uf storage capacitor C1 of FIG. 11 to produce a steady D.C. waveform as in (2) above by using a circuit similar to the diverter 63 providing interrupting means but arranged in series with the full-wave rectifier 50.

The primary differences between these three above operations (1), (2), and (3) to be described hereinafter is that in (1) the current is simply depleted before the end on the cycle, in (2) the current is strong and continuously available and flows at all times, but is momentarily and periodically diverted through a different path and in (3) the current is strong and continuously available from the capacitor C1 of FIG. 11 and full-wave bridge 50, but momentarily and periodically prevented from flowing by means of the serially arranged current diverter circuit 63 of FIG. 11.

Filament FIL 2 shown in FIGS. 10 and 11, in addition to serving as a current-limiting element for the gas discharge tube 18 also serves, in the circuit arrangement 60, as a current-limiting element in the event that the SCR devices of the bridge configuration 62 that are intended to be rendered nonconductive are suddenly and inadvertently made conductive. For example, if SCR2 and SCR4 are inadvertently triggered into conduction, a short circuit would result across the output of the rectifier bridge 50 formed by D1, D2, D3, D4, should the current through D9 not be limited by FIL 2 of the present invention.

The gas discharge tube 18 is maintained in its steady state run condition by a pulsed mode of operation determined by the combined waveforms of the full-wave bridge rectifier 50 and the D.C. TPA circuit arrangement 61. During the peak of each half-cycle, capacitor C1 is charged through diode D10 to the peak line voltage of approximately 170 volts. Meanwhile the full-wave rectifier 50 output is also supplying current to run the gas discharge tube 18 through the SCR bridge configuration 62. As the line voltage decays and drops below the extinction threshold (typically 50 volts), of the gas discharge tube 18, the gas discharge tube 18 ceases to conduct and the SCR pair which has been conducting then stops such conduction. As the voltage continues to decay, a voltage difference starts to build up across SCR6 and its associated bias network formed by R5 and R6 contained in the TPA circuit 61. This voltage difference is caused by the condition that 170 volts, due to C1, is present at the anode of SCR6 and the rectified line voltage on the cathode of SCR6 is decreasing. When the voltage difference across the series arrangement of R6 and R5 is sufficient to produce a trigger voltage for SCR6 (typically 105 volts), the SCR6 becomes conductive and connects 170 volts from C1 to the gas discharge tube 18 through the bridge configuration 62. At this time, the line voltage is getting lower and there is not enough current to trigger the SCR devices of the bridge configuration 62. At some point when the line starts to rise again, a pair of SCR's, SCR2 and SCR5 or SCR3 and SCR4, are triggered connecting the gas discharge tube 18 to the voltage supply of the full-wave rectifier 50, and the gas discharge tube 18 reignites. The voltage on capacitor C1 decays as the capacitor C1 supplies the current to run the gas discharge tube 18 while the rectified line voltage continues to rise. When the rectified line voltage exceeds that of the capacitor C1, the rectified line current supplies current to run the lamp and recharges C1 for another cycle.

The aforementioned circuit arrangement 60 particularly lends itself for operation with gas discharge lamps having two spot-mode electrodes which act alternately as anode and cathode to operate in an A.C. mode, because of the need of relatively low energy and the elimination by the present invention of the glow mode otherwise encountered during starting. The present invention develops a starting voltage of approximately 600 volts which is provided by the half-wave voltage quadrupler 59 of FIG. 10, and presented to the gas discharge tube 18 through resistor R4. Before breakdown, and initiation of the starting sequence, the high voltage is presented across the bridge configuration 62 causing diode D9 to be placed in back-biased condition. When breakdown of the gas discharge tube 18 occurs, the current from the voltage quadrupler 59 flows through resistor R4, through the appropriate elements of the bridge configuration 62 and through the gas discharge tube 18. When the starting voltage falls to that of the peak of the A.C. line, D9 is no longer back-biased and current starts to flow from the full-wave bridge rectifier and TPA circuit 61 so as to maintain the gas discharge tube 18 in its conductive state. The circuit arrangement 60 is not limited to the use of a voltage quadrupler 59, but may be used with a doubler, tripler, or any multi-stage voltage multiplier as deemed appropriate for the particular breakdown voltage and starting requirements of the specific design of the gas discharge tube 18.

The resistor R4 of circuit arrangement 60 serves a dual function. First, it slows the discharge of the voltage quadrupler 59 so as to promote starting of the gas discharge tube 18. Second, it acts in conjunction with the capacitors C10, C11, C12, and C13 to form a low-pass RC filter to minimize accidental rate-of-rise (dV/dT) anode voltage triggering of the SCR devices of the bridge configuration 62.

The circuit arrangement 60 of FIG. 10 has a further advantage in that it is able to maintain the gas discharge tube 18 in the steady-state run condition using a relatively small electrolytic capacitor of 10 uf for C1. However, circuit arrangement 60 has somewhat of a limitation in that it does not provide for square-wave operation of the gas discharge tube 18 because the voltage waveform of circuit arrangement 60 decays each half-cycle to a value below that at which the gas discharge tube 18 is able to maintain conduction and to a value below that which ensures that the SCR devices are desired to be turned-off. An A.C. square-wave operation of the gas discharge tube 18 advantageously simulates more closely the steady-state current and voltage conditions associated with D.C. operation.

A square-wave A.C. desired operation is provided by the circuit arrangement 66 of FIG. 11 more particularly, by the circuit 63 of FIG. 11 which essentially replaces the TPA circuit 61 in circuit arrangement 60 of FIG. 10. Table 7 gives the values and types for the circuit components of the circuit 63.

TABLE 7

| Element | Value or Type |
|---|---|
| R1 | 100 K ohms |
| R5 | 3.3 K ohms |
| R6 | 200 K ohms |
| C1 | 50 uf rated at 180 volts |
| Q1, Q2, Q3 | 2N6517 NPN Transistor |
| Q4 | MJE13004 NPN Transistor |

The circuit arrangement 66 of FIG. 11 is similar to but differs from the circuit arrangement 60 of FIG. 10 in that it does not use timed pulse additions (TPA). The circuit arrangement 66 comprises a shunt current diverter circuit 63 which is significantly different from the Timed Pulse Addition circuit 61, in that it diverts current away from the bridge configuration circuit 62, at preselected durations, to be described, of the A.C. applied signal 12 ensuring turn-off of the bridge configuration when desired. The shunt current diverter circuit 63 is arranged between one of the output nodes of the full-wave rectifier 50.

The circuit 63 provides a 50 uf capacitor C1 storage element equivalent to the D.C. bridge rectifier power supply circuit described previously for the circuit arrangement 52 in FIG. 6. The circuit arrangement 63 has a diode D10 which provides a means of obtaining an unfiltered rectified voltage waveform for the purpose of controlling the switching of transistor Q1. Transistors Q2, Q3, and Q4 are configured in a tandem current amplification arrangement 64 with the collector of each transistor Q2, Q3, and Q4 commoned together and connected to a node C feeding the bridge configuration 62 previously described with reference to the circuit arrangement 60. Resistor R1 of circuit 63 provides bias current to turn-on the circuit arrangement 64, which, in turn, periodically and momentarily shorts out the voltage available from the full-wave bridge rectifier 50 thereby diverting the current through transistor Q4 so as to advantageously ensure that all the silicon control rectifiers of the bridge configuration 62 are turned-off. The circuit arrangement 64 is normally held in an off or nonconducting condition by transistor Q1 which is normally conducting by virtue of the voltage waveform supplied to a bias network formed by R5 and R6 arranged with Q1.

In operation of circuit arrangement 63, whenever the rectified line of circuit 50 is above a threshold determined by R6 and R5 of circuit 63, Q1 is conductive and tandem arrangement 64 of Q2, Q3, and Q4 is nonconductive. Whenever the rectified waveform of circuit 50 falls below the threshold established by R5 and R6 which occurs every half-cycle when the line is close to zero crossing, Q1 ceases conduction, which, in turn, allows the tandem arrangement 64 to conduct so as to divert the current flowing through FIL 2 away from the SCR bridge configuration 62, thereby ensuring turn-off of all the SCR's in the bridge. The operation of circuit arrangement 63 is dependent, in part, upon the presence of the current-limiting filament FIL 2 which prevents a short circuit across the capacitively filtered full-wave rectifier 50 in a similar manner to that previously described for the SCR of the bridge configuration 62.

The above operation of circuit 63 supplies a desired D.C. waveform between interruptions which is similar to that of arrangement 52, except that the D.C. waveshape is periodically interrupted (for a short and abrupt period on the order of 1 ms) so as to allow the bridge configuration 62 to turn-off and reverse the polarity of configuration 62 to turn-off and reverse the polarity of the gas discharge tube 18, thereby producing the desired square-waveform.

In addition to the transistors specified for circuit 64, this invention contemplates the use of alternate switching devices, including but not limited to, bipolar transistors, field-effect transistors, and insulated gate rectifiers. Alternately, it is contemplated that a series current interrupter circuit may be implemented similar to the shunt current diverter circuit 63 of FIG. 11 but arranged in series between the full-wave rectifier 50, and the bridge configuration of FIG. 9.

More particularly, for a series current interrupter circuit the tandem arranged transistor 64 is now inserted in series with the cathode of diode D10 and the first terminal of filament F2, the second terminal of which is still connected to node C. The cathode of diode D10 forms a node which is connected to (1) the first terminal of the resistor R1, (2) the first terminal of an added resistor R7 having a typical value of 100K Ω, and (3) the positive terminal of the capacitor C1. The second terminal of the resistor R7 is connected to an added transistor Q5 and to the base of transistor Q2 of the tandem arrangement 64.

In contrast to the circuit arrangement 66 of FIG. 11, the second terminal of resistor R1 along with the collector of transistor Q1 is now connected to the base of the added transistor Q5. Further, in contrast to the shunt current diverting circuit 63 of FIG. 11, the series current interrupter circuit having the added transistor Q5 and resistor R7, interrupts the current through transistor Q4 so as to advantageously ensure that all of the silicon control rectifiers of the bridge configuration 62 are turned-off at their desired durations.

It should now be appreciated that the circuit arrangement 60 of FIG. 10 and the circuit arrangement 66 of FIG. 11 permits the use of D.C. low-energy starting circuitry even when operating a gas discharge tube 18 in the A.C. mode, and that the circuit arrangements 60 and 66 perform their desired functions primarily due to the spot-mode electrodes of the present invention. The operation of gaseous discharge tube 18 in the A.C. mode is preferable over the D.C. mode so as to facilitate more uniform color output with various orientations of the lamp relative to the gravitational attraction of the earth.

It should now be appreciated that the present invention provides for various ballast circuits as described with regard to FIGS. 6 through 11 used in conjunction with various spot-mode electrodes described with reference to FIGS. 3*a* through 3*j*. The present invention may be further described with regard to the theory of operation of the spot-mode electrodes of FIGS. 3*a*–3*j*.

The spot-mode electrodes of FIGS. 3*a*–3*j* have a fundamental property in that they support a low voltage arc condition immediately after the high voltage breakdown mode occurs as described with regard to FIGS. 5*a* and 5*b*.

The run mode operation of the spot-mode electrodes is rapidly reached through a low voltage high current arc rather than a prerequiste glow mode of operation of prior art electrodes. The spot-mode electrodes do not require a D.C. voltage greater than can typically be made available from a household source, such as 120 volts A.C. RMS, after breakdown. The spot-mode starting of the present invention relies on an arc mode indicative of vacuum arc type behavior.

Vacuum arcs may be better identified by that condition in which arcs produce the necessary plasma by evaporation and ionization of the material of the spot-mode electrodes as opposed to ionization of a gas. This definition also allows for the possibility of vacuum arc type operation to occur when a gas, such as those within the housing 20 lodging the spot-mode electrodes, is present.

Figure 12:
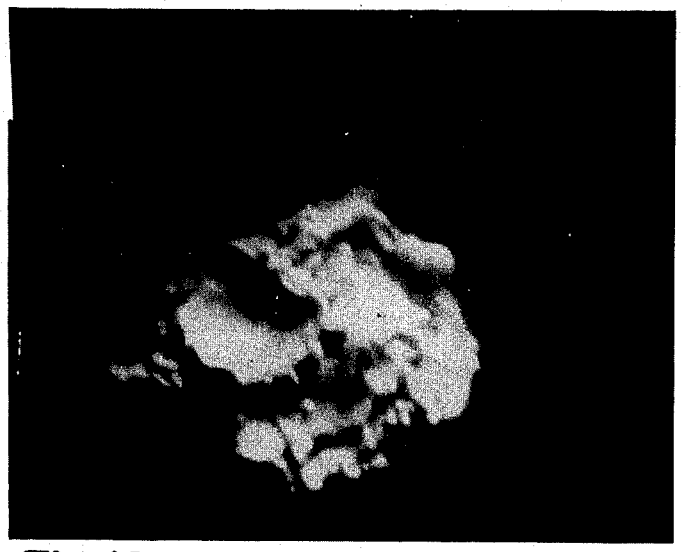
FIG. 12 is a Scanning Electron Microscope (SCM) micrograph of a crater on the surface of a spot-mode electrodes of the present invention.

For the material specified in Table 3, vacuum arcs may carry from below one (1) ampere to several thousand amperes with a gap voltage (the voltage between the electrodes within the housing 20) in the range of ten (10) to twenty (20) volts. The vacuum arc of the spot-mode electrodes are those where the electron-emitting areas of the spot-mode electrodes are hot enough to cause the necessary spot-mode electrode material evaporation so as to leave artifacts in the form of melted craters on the surface of the spot-mode electrodes. The transient currents of about 100 amperes and about 10 amperes, previously discussed with regard to FIG. 5(*b*), primarily create the craters. A Scanning Electron Microscope (SEM) of a crater on the surface of the electrode is shown in FIG. 12 at 3000 times magnification.

The heating of the porous structure of the spot-mode electrodes occurs by thermal conduction from the emitting spot which leads to an emission mechanism which is highly thermionic in nature. The structure of the spot-mode electrodes allows the spot to remain hot enough to produce enough electrons so as to sustain a vacuum arc condition within the gas discharge tube. As the material of the spot-mode electrodes begins to sinter the heated spot begins to cool by conduction, the vacuum type arc process moves to a different spot so as to continue the desired electron production. Because the initially formed spot is hot enough to provide the necessary electrons and also because the combination of resistive heating of the electrodes and ion bombardment heating by the gas are able to overcome the different energy loss mechanism, such as electron evaporation energy, radiation and conduction, the emitting spot is sustained by the current supplied to the spot-mode electrodes by the ballast circuit.

As the whole spot-mode electrode structure is heated, the thermionic emission from the complete electrode becomes sufficient to supply the needs of the thermionic arc condition within the gas discharge tube and the isolated heated spot of the spot-mode electrodes is no longer required.

In accordance with the practice of this invention, testing was performed on the gas discharge tube 18 having the spot-mode electrodes coated with various compositions both as hereinabove described for the present invention. The circuit used to perform the testing is shown in FIG. 13 and the results of the performed testing are illustrated in FIG. 14.

Figure 13:
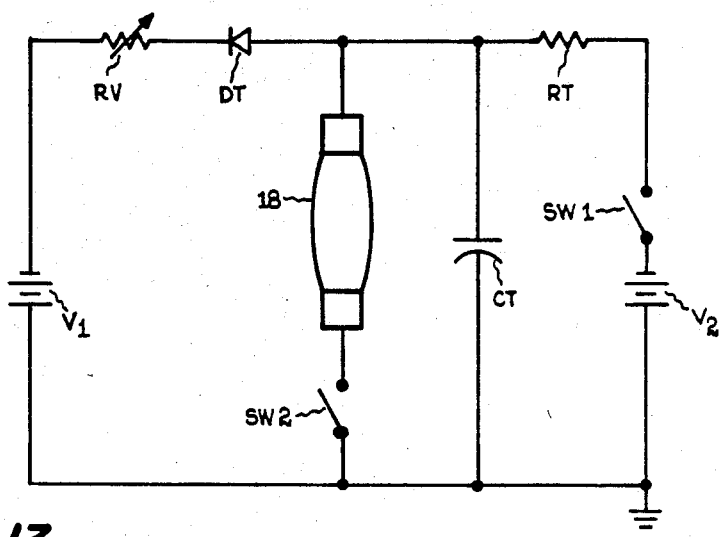
FIG. 13 is a circuit diagram used to perform testing on the spot-mode electrodes of the present invention.
Figure 14:
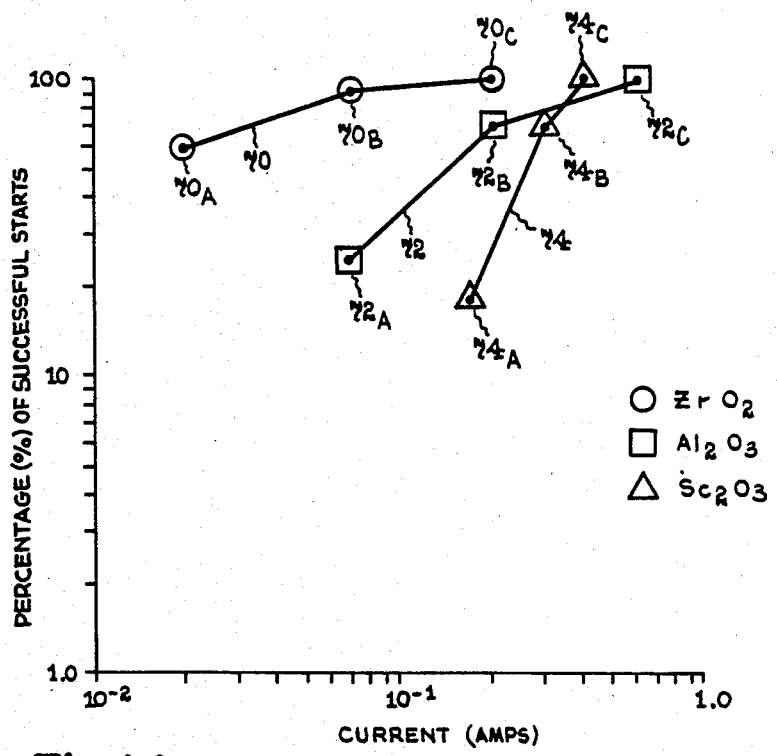
FIG. 14 illustrates the results of the testing performed on the spot-mode electrodes.

The test circuit arrangement of FIG. 13 showing the gas discharge tube 18 of the present invention comprises: (1) two D.C. supplies $V_1$ and $V_2$ of a constant current 150V–5A power and a high voltage, usually 1,000V, low current power, respectively; (2) two manual switches SW1 and SW2; (3) a potentiometer RV having a variable resistance between 0 to 200 ohms; (4) a diode DT; (5) a resistor RT having a typical value of 5 megaohms; and (6) a capacitor CT having a typical value of 0.05 microfarads.

The voltage $V_1$ has its positive polarity terminal connected to a ground potential and its negative polarity terminal connected to one end of potentiometer RV which has its other end connected to the cathode of diode DT. The anode of diode DT is connected to: (1) one end of gas discharge tube 18; (2) one end of resistor RT; and (3) one end of capacitor CT. The other end of gas discharge tube 18 is connected to the ground potential via switch S2. The other end of capacitor CT is connected to the ground potential. The other end of resistor RT is connected to the negative terminal of $V_2$ via switch SW1. The positive terminal of $V_2$ is connected to the ground potential.

The procedure for testing the gas discharge tube 18 was a six-step process: (1) with SW2 open, SW1 was closed and CT was charged to the $V_1$ supply having a voltage of about 1,000V; (2) SW1 was then opened and SW2 was then closed; (3) the initial voltage breakdown mode of the gas discharge tube 18 then occurred; (4) current then flowed from CT through the gas discharge tube 18 until the voltage across the gas discharge tube 18 and across CT, dropped to the voltage set at power supply $V_1$; (5) current was then supplied to the gas discharge tube 18 at a preset value (to be described) by potentiometer RV; and (6) as soon as the gas discharge tube was observed to start, usually within one (1) second, the switch SW2 was then opened.

In general, the testing performed consisted of connecting, via switch S2, the spot-mode electrode serving as the cathode of the gas discharge tube into the circuit of FIG. 13 and determining the amount of constant current that allowed the gas discharge to be successfully started 100 times and also sustain its thermionic emission. The tip portion of spot-mode electrodes were coated with various cermet materials previously described and the results of the testing of these spot-mode electrodes bearing an amount of the various cermet materials are shown in FIG. 14.

FIG. 14 shows three plots 70, 72 and 74 representative of the testing performed on spot-mode electrodes having respective coating of: zirconium oxide ($ZrO_2$); alumina oxide ($Al_2O_3$) and scandium oxide ($Sc_2O_3$). The testing points of interest related to plots 70, 72, and 74 are indicated, respectively, by circles for $70_A$, $70_B$ and $70_C$, boxes for $72_A$, $72_B$ and $72_C$ and triangles for $74_A$, $74_B$ and $74_C$.

The cermet coating of plots 70, 72 and 74 of FIG. 14 were applied to an electrode structure having a shape described for FIG. 3*a* and these cermet coatings were of a material described for Table 3.

FIG. 14 has an X coordinate (given in amperes) of the applied current established by the selection of the resistive value of RV of FIG. 14, that was used to start and sustain the thermionic arc condition of the gas discharge tube. Further FIG. 14 has a Y coordinate with a maximum value of 100 corresponding to the percentage (%) of successful starts related to plots 70, 72 and 74.

The points of interest $70_A \ldots 72_A \ldots 74_A \ldots 74_C$ of the testing performed on the spot-mode electrodes having tip portions coated with the material of plots 70, 72, and 74 are tabulated in approximate form in Table 8.

TABLE 8

| Points of Interest | Sustaining Current Given in Milliamperes | % of Successful Starts |
|---|---|---|
| $70_A$ | 20 | 60 |
| $70_B$ | 70 | 90 |
| $70_C$ | 200 | 100 |
| $72_A$ | 70 | 25 |
| $72_B$ | 200 | 70 |
| $72_C$ | 600 | 100 |
| $74_A$ | 175 | 18 |
| $74_B$ | 300 | 70 |
| $74_C$ | 600 | 100 |

The results given in Table 8 are illustrative of the spot-mode electrodes of the present invention experience successful starting in the initial breakdown mode of operation, previously described hereinbefore, and attain and sustain a thermionic emission in the run-mode of operation previously described hereinbefore. More particularly, the spot-mode electrodes of the present invention are successfully operated without the need of the prior art glow-mode of operation.

It should now be appreciated that, the present invention provides for spot-mode electrodes operating in conjunction with various ballast circuits hereinbefore described that provide for a gas discharge tube having only two modes of operation those being the initial high voltage breakdown mode and the run mode.

Although the hereinbefore given description is related to the spot-mode electrodes housed in the improved light unit 10 of FIG. 1, the practice of this invention contemplates that the spot-mode electrodes of this invention may be used in various lighting lamp applications. For such applications, one or more spot-mode electrodes need only be lodged in a suitable gas discharge tube, such as gas discharge tube 18, and be rendered thermionic in response to a ballast circuit supplying the necessary voltage and current conditions such as those conditions supplied by the ballast circuits of FIGS. 6–11.

Further, although the hereinbefore description of the elements of the ballast circuits have been given values for operation at 60 Hertz, it should be recognized that the practice of this invention contemplates ballast circuits having selected values for operation at 50 Hertz. Even further, the practice of this invention contemplates ballast circuits operating with A.C. sources having predetermined voltages at predetermined frequencies in the range of about 25 Hertz to about 400 Hertz.

What we claim as new and desire to secure by Letters Patent of the United States is:

1. An improved electrode for use in a gas discharge tube and capable of being rendered thermionic in response to a ballast circuit, said gas discharge tube comprising a light-transmissive envelope containing (1) an inert gas having a fill pressure of about 10 torr to about 500 torr; (2) a metal selected from the group consisting of mercury and mercury cadmium amalgam and alloys thereof; and (3) a metal halide gas selected from the group of compounds of sodium iodide and scandium iodide;

said ballast circuit comprising means for sequentially supplying to said improved thermionic electrode, (1) breakdown high voltage in the range of about 300 volts to about 2000 volts, and (2) a voltage in the range of about 0 volts to about 170 volts with limiting steady state currents in the range of about 0.3 ampere to about 0.6 ampere and transient currents of about 100 amperes and about 10 amperes; and said improved thermionic electrode comprising a cermet material covering at least a portion of said electrode, said cermet material having a particle size in the range of about 1.0 microns to about 50 microns and comprised of a tungsten powder and a metal oxide having respective percent weight ratios in the range of 98 to 70 and 2 to 30, said metal oxide being formed from a metal selected from the group consisting of scandium, aluminum, dysprosium, thorium, yttrium and zirconium and mixtures of the selected metals.

2. An improved thermionic electrode according to claim 1 wherein said cermet material covering has a predetermined length in the range of about 0.5 mm to about 1.5 mm, and a predetermined thickness in the range from about 0.2 mm to about 1.0 mm.

3. An improved electrode according to claim 1 wherein said cermet material covering has a predetermined length of about 1.5 mm and a predetermined thickness arranged in a tapered manner wherein the highest region is about 0.4 mm and the lowest region is about 0.025 mm.

4. An improved thermionic electrode according to claim 1 wherein said electrode has a cylindrical shape, a diameter of about 0.3 mm and a length in the range of about 1.5 mm to about 2.0 mm.

5. An improved electrode according to claim 1 having a diameter of about 0.3 mm and comprised of a first and a second section each of a respective length of about 0.5 mm, said first and second sections being axially separated from each other by a distance of about 0.5 mm, said first and second section having wrapped thereabout a tungsten wire having a wire diameter of about 0.18 mm with a wrapped length of about 0.9 mm, and the distance between wrapped turns of wire of about 160% of the diameter of said improved electrode, said improved electrode further comprising said cermet material covering according to claim 1 and having a thickness of about 0.25 mm and coating: (1) said first section, (2) said axial separation, and (3) a major portion of said second section all having said wrapped tungsten wire.

6. An improved electrode according to claim 1 having a diameter of about 0.3 mm and comprised of a first and a second section each of a respective length of about 0.5 mm, said first and second sections being axially separated from each other by a distance of about 0.5 mm, said first and second section having wrapped thereabout a tungsten wire having a wire diameter of about 0.18 mm with a wrapped length of about 0.9 mm, and the distance between wrapped turns of wire of about 160% of the diameter of said improved electrode, said improved electrode further comprising a cermet material according to claim 1 lodged under said wrapped tungsten wire and located between said axially separated first and second sections of said improved electrode.

7. An improved electrode according to claim 1 having a diameter of about 0.3 mm and comprised of a first and a second section each of a respective length of about 0.5 mm, said first and second sections being axially separated from each other by a distance of about 0.5 mm, said first and second section having wrapped thereabout a tungsten wire having a wire diameter of about 0.18 mm with a wrapped length of about 0.9 mm, and the distance between wrapped turns of wire of about 160% of the diameter of said improved electrode, said improved electrode further comprising a cermet material according to claim 3 covering: (1) all of said first section of said electrode; (2) said axial separation between said first and second sections; and (3) a portion of said second section.

8. An improved electrode according to claim 5 further comprising a cermet material accOrding to claim 1 covering a major portion of said first section.

9. A lighting unit having at least one improved thermionic electrode being housed in a gas discharge tube and responsive to the ballast circuit all of claim 1, said lighting unit having a light-transmissive outer envelope, a housing lodging said ballast circuit, and an electrically conductive base, said lighting unit further comprising:

at least one filament within the outer envelope serving as a resistive element and as a supplementary light source; and said gas discharge tube serving as a main light source for said unit and spatially disposed within said outer envelope.

10. An improved lighting unit according to claim 9 wherein said ballast circuit comprises:

(a) a full-wave rectifier adapted to accept an applied alternating current (A.C.) source having a predetermined voltage at a predetermined frequency;

(b) at least one voltage multiplier circuit for developing said breakdown voltage which initiates the thermionic arc condition of said gas discharge tube and having an energy storage capacitor in the range of 0.001 to 1.0 microfarads; and (c) current sustaining means for continuing to supply to said gas discharge tube for a predetermined duration limiting steady state currents in the range of from 0.3 amperes to about 0.6 amperes and with transient currents of about 100 amperes and about 10 amperes after the initiated thermionic arc condition.

11. An improved lighting unit according to claim 10 wherein said ballast circuit further comprises a resistor and capacitor arranged across the output nodes of said full-wave rectifier, and a capacitor arranged across the applied alternating current (A.C.) source.

12. An improved lighting unit according to claim 9 wherein said lighting unit contains a first and a second filament, said second filament being serially arranged with said gas discharge tube.

13. An improved lighting unit according to claim 12 wherein said ballast circuit comprises:

(a) a full-wave rectifier adapted to accept an applied alternating current (A.C.) source having a predetermined voltage at a predetermined frequency;

(b) at least one voltage multiplier circuit for developing said breakdown voltage which initiates the thermionic arc of said gas discharge tube, and having an energy storage capacitor in the range of about 0.001 to about 1.0 microfarads; and (c) current sustaining means for continuing to supply to said gas discharge tube for a predetermined duration a current in the range of 0.3 to 0.6 amperes after the initiated thermionic arc condition.

14. An improved lighting unit according to claim 12 wherein said ballast circuit comprises:

(a) a full-wave rectifier having a positive first output node and a negative second output node and adapted to accept an applied alternating current (A.C.) source having a predetermined voltage at a predetermined frequency;

(b) a first switching means serially connected with said first filament and having a bias network arranged to render said first switching means conductive during the presence of said breakdown voltage;

(c) a timed pulse addition network arranged across the first and second output nodes of said full-wave rectifier, said timed pulse addition network comprising a diode connected across serially arranged first and second resistors, which in turn is connected across a second switching means, the resistive value of the node of the first and second resistors connected to the control gate of said second switching means determining the bias and the conductive state of said second switching means, the cathode of said diode being connected to a node formed by one end of a parallel arrangement composed of a third resistor and of a first capacitor having its other node connected to the second of said output nodes of said full-wave rectifier, the anode of said diode being connected to the anode of said second switching means, said first and second resistors having values to render said second switching means conductive at a predetermined portion of the applied A.C. signal, said first capacitor having a value so that it discharges sufficiently by the end of the half-cycle of said applied A.C. signal effective that the voltage across the arc tube falls below its extinction potential;

(d) a bridge configuration connected between one end of said second filament and said second output node, said bridge configuration comprised of a third switching means and a second capacitor, a fourth switching means and a third capacitor, a fifth switching means and a fourth capacitor and a sixth switching means and a fifth capacitor, each of said third, fourth, fifth and sixth switching means having a bias network to respectively render each of said switching means conductive at a predetermined portion of the applied A.C. signal, said third, fourth, fifth and sixth switching means further being arranged in a first and second pairs which conduct during the same said predetermined portion of said applied A.C. signal, said gas discharge tube being serially arranged with each of said first and second pairs of said switching means, and;

(e) a multi-stage voltage multiplier circuit having energy storage means for developing said breakdown voltage which initiates said thermionic arc condition of said gas discharge tube.

15. An improved lighting unit according to claim 12 wherein said ballast circuit comprises:

(a) a full-wave rectifier having a positive first output node and a negative second output node comprised of a first, second, third and fourth diode and adapted to accept an alternating current (A.C.) source having a predetermined voltage at a predetermined frequency applied across said second and fourth diodes;

(b) a first switching means serially connected with said first filament across the applied alternating current (A.C.) source and having a bias network arranged to render said first switching means conductive during the presence of said breakdown voltage;

(c) a shunt current diverter network arranged between the first and second output nodes of said full-wave rectifier, said shunt current diverter network comprising first and second resistors serially connected across said first and second output nodes, said serially connected first and second resistors having a first end connected to the anode of a fifth diode and said first output node, and a second end connected to the second output node and also to one end of a first capacitor having its other end connected to the cathode of said fifth diode, said first and second resistors having its node connected to the base of a second switching means, said second switching means having its emitter connected to said second output node and its collector connected to a node formed by one end of a third resistor and the base of a tandem arranged transistor amplifier, said third resistor having its other end connected to said cathode of said fifth diode, said tandem arranged switching amplifier having its emitter connected to said second output node and its collectros connected to one end of the second filament having its other end connected to the cathode of said fifth diode; (d) a bridge configuration connected between said collectors of the tandem arranged transistor amplifier and said second output node, said bridge configuration comprised of a third switching means and a second capacitor, a fourth switching means and a third capacitor, a fifth switching means and a fourth capacitor, and a sixth switching means and a fifth capacitor, each of said third, fourth, fifth and sixth switching means having a bias network to respectively render each of said switching means conductive at a predetermined portion of the applied A.C. signal, said third, fourth, fifth and sixth switching means further being arranged in a first and second pair which conduct during the same said predetermined portion of said applied A.C. signal, said gas discharge tube being serially arranged with each of said first and second pairs of said switching means, and;

(e) a multi-stage multiplier for developing said breakdown voltage which initiates said thermionic arc condition of said discharge tube.

16. An improved lighting unit according to claim 12 wherein said ballast circuit comprises:

(a) a full-wave rectifier with first and second output nodes comprised of a first, second, third and fourth diode and adapted to accept an alternating current (A.C.) source having a predetermined voltage at a predetermined frequency applied across said second and fourth diodes;

(b) a first switching means serially connected with said first filament across the applied alternating current (A.C.) source and having a bias network arranged to render said first switching means conductive during the presence of said breakdown voltage;

(c) a series current interrupter network arranged in series between said full-wave rectifier first output node and a bridge configuration, said series current interrupter network comprising a first and second resistor serially connected across said first and second output nodes, said serially connected first and second resistors having a first end connected to the anode of a fifth diode and said first output node, and a second end connected to the second output node and also to one end of a first capacitor having its other end connected to the cathode of said fifth diode, said first and second resistors having its node connected to the base of a second switching means, said second switching means having its emitter connected to said second output node and its collector connected to a node formed by one end of a third resistor and the base of a third switching means, said third resistor having its other end connected to said cathode of the fifth diode, said third switching means having its emitter connected to said second output node, said third switching means having its collector connected to the base of a first transistor of a tandem arranged transistor amplifier, said tandem arranged switching amplifier having its output emitter connected to one end of said second filament having its other end connected to said bridge configuration, said tandem arranged transistor amplifier having its collectors connected to the cathode of said fifth diode;

(d) said bridge configuration comprised of a fourth switching means and a second capacitor, a fifth switching means and a third capacitor, a sixth switching means and a fourth capacitor, and a seventh switching means and a fifth capacitor, each of said fourth, fifth sixth and seventh switching means having a bias network to respectively render each of said switching means conductive at a predetermined portion of the applied A.C signal, said fourth, fifth, sixth and seventh switching means further being arranged in a first and second pair which conduct during the same said predetermined portion of said applied A.C. signal, said gas discharge tube being serially arranged with each of said first and second pairs of said switching means, and;

(e) a multi-stage multiplier for developing said breakdown voltage which initiates said thermionic arc condition of said discharge tube.

* * * * *